US008754733B2

(12) United States Patent
Koren

(10) Patent No.: US 8,754,733 B2
(45) **Date of Patent: *Jun. 17, 2014**

(54) PORTABLE MAGNETIZER SYSTEMS

(75) Inventor: Trygve Paul Koren, Newport, OH (US)

(73) Assignee: Magnum Magnetics Corporation, Marietta, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/437,596

(22) Filed: Apr. 2, 2012

(65) Prior Publication Data

US 2012/0188036 A1 Jul. 26, 2012

Related U.S. Application Data

(63) Continuation-in-part of application No. 12/851,518, filed on Aug. 5, 2010, now Pat. No. 8,174,346.

(60) Provisional application No. 61/232,297, filed on Aug. 7, 2009, provisional application No. 61/251,278, filed on Oct. 13, 2009, provisional application No. 61/471,592, filed on Apr. 4, 2011, provisional application No. 61/506,793, filed on Jul. 12, 2011.

(51) Int. Cl.
*H01F 13/00* (2006.01)

(52) U.S. Cl.
USPC ..... 335/284

(58) Field of Classification Search
USPC ..... 335/284; 283/82
See application file for complete search history.

(56) References Cited

U.S. PATENT DOCUMENTS

| | | | | |
|---|---|---|---|---|
| 1,444,299 | A * | 2/1923 | Benner | 335/284 |
| 2,125,628 | A | 12/1933 | Fredrickson | |
| 4,180,257 | A * | 12/1979 | Buccicone | 271/193 |
| 5,025,240 | A * | 6/1991 | La Croix | 335/284 |
| 5,063,367 | A | 11/1991 | Lee | |
| 6,094,120 | A * | 7/2000 | Okamoto | 335/284 |
| 6,310,532 | B1 * | 10/2001 | Santa Cruz et al. | 335/284 |
| 6,356,176 | B1 * | 3/2002 | Anderson | 335/284 |
| 6,668,689 | B1 * | 12/2003 | Lai | 81/451 |
| 6,776,409 | B2 * | 8/2004 | Cook | 271/189 |
| 6,853,280 | B2 * | 2/2005 | Sugawara et al. | 335/284 |
| 7,415,756 | B2 * | 8/2008 | Ishida et al. | 29/598 |
| 7,728,706 | B2 | 6/2010 | Ogden, Jr. et al. | |
| 2001/0042590 | A1 * | 11/2001 | Neuburger | 156/250 |
| 2004/0009370 | A1 * | 1/2004 | Abe | 428/693 |
| 2007/0191670 | A1 | 8/2007 | Spector | |
| 2008/0224806 | A1 | 9/2008 | Ogden et al. | |
| 2008/0278272 | A1 | 11/2008 | Arnold | |

FOREIGN PATENT DOCUMENTS

| | | | |
|---|---|---|---|
| JP | 6036402 | U | 5/1994 |
| KR | 20-1996-0032614 | B2 | 10/1996 |

* cited by examiner

*Primary Examiner* — Alexander Talpalatski
(74) *Attorney, Agent, or Firm* — Stoneman Law Patent Group; Martin L. Stoneman; David A. Spellman

(57) ABSTRACT

Portable magnetizer systems designed for on-site use, related to magnetizing magnetizable sheets, enclosed in a portable case which is hand-carryable.

22 Claims, 15 Drawing Sheets

PORTABLE MAGNETIZER SYSTEMS

CROSS REFERENCE TO RELATED APPLICATIONS

The present application is a continuation-in-part and is related to and claims priority from application Ser. No. 12/851,518, filed Aug. 5, 2010, entitled "PORTABLE MAGNETIZER SYSTEMS", and which application is related to and claims priority from prior provisional application Ser. No. 61/232,297, filed Aug. 7, 2009, entitled "PORTABLE MAGNETIZER SYSTEMS"; and, this application is related to and claims priority from prior provisional application Ser. No. 61/251,278, filed Oct. 13, 2009, entitled "PORTABLE MAGNETIZER SYSTEMS". Furthermore, the present application is related to and claims priority from application Ser. No. 61/471,592, filed Apr. 4, 2011, entitled "PORTABLE MAGNETIZER SYSTEMS" and is related to and claims priority from application Ser. No. 61/506,793, filed Jul. 12, 2011, entitled "PORTABLE MAGNETIZER SYSTEMS", the contents of each of which is incorporated herein by this reference and is not admitted to be prior art with respect to the present invention by the mention in this cross-reference section.

BACKGROUND

This invention relates to providing a system for a portable magnetizer. More particularly this invention relates to providing a portable system for magnetizing batches of magnetizable sheets.

Magnetizing of magnetizable sheeting is either conducted during manufacture or in large production lines. When only a small batch of sheets needs magnetizing, it is inefficient to utilize large scale methods of magnetization. A high-volume production magnetizer is expensive and may take up too much space for the benefit of smaller scale, occasional use on-site. Likewise, taking a batch of sheets in to a high-volume production company for magnetization slows down production and consequently the high-volume production company charges increased fees. A system is needed to magnetize on-site, for less cost, in a portable and space saving manner.

OBJECTS AND FEATURES OF THE INVENTION

A primary object and feature of the present invention is to provide a system overcoming the above-mentioned problem.

It is a further object and feature of the present invention to provide such a system in a portable storage case.

Another object and feature of the present invention is to provide such a system having a rotating magnetic roller to magnetize magnetizable planar sheets.

It is an additional object and feature of the present invention to provide such a system that is capable of being carried by hand.

Another object and feature of the present invention is to provide such a system having a magnetic roller of discrete field-producing laminations.

Yet a further object and feature of the present invention is to provide such a system having sheet decouplers to separate a magnetized sheet from such magnetic roller.

It is another object and feature of the present invention to provide such a system having a magnetic field between 4000 Gauss and 6000 Gauss.

A further object and feature of the present invention is to provide such a system that is capable of magnetizing magnetizable planar sheets having a width of less than 13 inches.

Another primary object and feature of the present invention is to provide such a system that is capable of high-energy magnetization of a high-energy magnetizable sheet.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system, relating to enabling magnetization of at least one planar sheet of flexible magnetizable material, such system comprising: magnetizer means for providing at least one magnetic field source; positioner means for permitting positioning the at least one planar sheet into at least one magnetizing interaction relationship with such magnetizer means; enclosure means for enclosing such magnetizer means and such positioner means; and hand-carrier means for permitting hand-carrying of such enclosure means. Moreover, it provides such a system further comprising axial-holder means for axially-holding such magnetizer means along a single longitudinal axis. Additionally, it provides such a system further comprising rotary movement generator means for generating rotary movement of such axial-holder means. Also, it provides such a system wherein such enclosure means comprises securable briefcase means for providing briefcase-securing of such enclosure means.

In accordance with another preferred embodiment hereof, this invention provides a system, relating to enabling magnetization of at least one planar sheet of flexible magnetizable material, such system comprising: at least one magnetizer structured and arranged to provide at least one magnetic field source; at least one positioner structured and arranged to permit positioning the at least one planar sheet into at least one magnetizing interaction relationship with such at least one magnetizer; at least one enclosure structured and arranged to enclose such at least one magnetizer and such at least one positioner; and at least one hand-carrier structured and arranged to permit hand-carrying of such at least one enclosure. In addition, it provides such a system wherein such at least one magnetizer comprises at least one permanent magnet.

And, it provides such a system wherein: such at least one magnetizer comprises at least one magnetizer bar comprising at least one longitudinal axis; such at least one magnetizer bar comprises a plurality of discrete field-producing lamination-sets spaced along such at least one longitudinal axis; each discrete field-producing lamination-set of such plurality comprises at least one circular magnetic disk and at least one circular flux-conducting spacer magnetically coupled with such at least one circular magnetic disk; and each such at least one circular magnetic disk and each such at least one circular flux-conducting spacer are coaxial with such at least one first longitudinal axis. Further, it provides such a system further comprising at least one axial-holder structured and arranged to axially-hold such at least one magnetizer bar along such at least one longitudinal axis.

Even further, it provides such a system further comprising at least one rotary movement generator structured and arranged to generate rotary movement of such at least one axial-holder and such at least one magnetizer bar. Moreover, it provides such a system wherein such at least one magnetizer bar is structured and arranged to magnetically couple to the at least one planar sheet to transfer movement to the at least one planar sheet. Additionally, it provides such a system wherein such at least one magnetizer bar is structured and arranged to rotate to move the at least one planar sheet through at least one magnetic field. Also, it provides such a system further comprising at least one planar sheet decoupler structured and arranged to decouple the at least one planar sheet from such at least one magnetizer bar during movement of the at least one planar sheet through at least one magnetic field. In addition, it provides such a system wherein such at least one magnetizer bar is structured and arranged to rotate to move the at least one planar sheet through such at least one magnetic field at a rate from about 10 feet per minute to about 50 feet per minute.

And, it provides such a system wherein such at least one magnetizer bar rotates to move the at least one planar sheet through such at least one magnetic field at a rate of at about 15 feet/min. Further, it provides such a system wherein such at least one sheet decoupler comprises a plurality of decoupler elements. Even further, it provides such a system wherein each of such plurality of decoupler elements are spaced about every inch along such at least one longitudinal axis. Moreover, it provides such a system wherein such at least one magnetizer bar comprises from about 10 to about 20 laminations per inch. Additionally, it provides such a system wherein such at least one magnetizer bar comprises exactly 12 laminations per inch.

Also, it provides such a system wherein such at least one magnetizer bar comprises a magnetic field of about 5000 Gauss to about 6000 Gauss. In addition, it provides such a system wherein such at least one magnetizer bar comprises exactly 16 laminations per inch. And, it provides such a system wherein such at least one magnetizer bar comprises a magnetic field of about 4000 Gauss to about 5000 Gauss. Further, it provides such a system wherein such at least one positioner comprises at least one user-adjustable planar sheet feeder structured and arranged to user-adjustably feed the at least one planar sheet into such at least one magnetizer. Even further, it provides such a system wherein such at least one adjustable planar sheet feeder accepts a sheet width of less than about 13 inches. Moreover, it provides such a system wherein such at least one adjustable planar sheet feeder collapses to allow containment in such at least one enclosure when stored.

Additionally, it provides such a system wherein such at least one rotary movement generator comprises at least one motor. Also, it provides such a system further comprising: at least one power cord structured and arranged to assist power transfer from at least one power source to such at least one rotary movement generator; wherein such at least one power cord may be contained in such at least one enclosure when stored. In addition, it provides such a system wherein such at least one enclosure comprises at least one securable briefcase structured and arranged to provide briefcase securing of such at least one enclosure. And, it provides such a system wherein such at least one hand-carrier comprises at least one handle. Further, it provides such a system further comprising at least one mounting member structured and arranged to mount, in at least one operational alignment, such at least one positioner and such at least one magnetizer to such at least one enclosure.

Even further, it provides such a system further comprising at least one mounting member structured and arranged to mount, in at least one operational alignment, such at least one positioner and such at least one magnetizer to such at least one enclosure. Even further, it provides such a system wherein such at least one mounting member comprises at least one aligning-mounting plate. Even further, it provides such a system wherein such at least one aligning-mounting plate mounts to such at least one enclosure. Even further, it provides such a system wherein such at least one aligning-mounting plate divides such at least one enclosure into: at least one operation-isolated-region structured and arranged to assist protection of such at least one magnetizer and such at least one rotary movement generator from external interaction, during operation of such at least one magnetizer; and at least one operation-accessible-region structured and arranged to permit user access during operation of such at least one magnetizer. Even further, it provides such a system wherein such at least one enclosure comprises at least one aperture structured and arranged to permit operating power connection between such at least one rotary movement generator and external power source.

In accordance with another preferred embodiment hereof, this invention provides a system, relating to enabling magnetization of at least one planar sheet of flexible magnetizable material, such system comprising: at least one magnetizer structured and arranged to provide at least one magnetic field source; at least one positioner structured and arranged to permit positioning the at least one planar sheet into at least one magnetizing interaction relationship with such at least one magnetizer; at least one enclosure structured and arranged to enclose such at least one magnetizer and such at least one positioner; and at least one hand-carrier structured and arranged to permit hand-carrying of such at least one enclosure. Moreover, it provides such a system wherein such at least one magnetizer comprises at least one permanent magnet. Additionally, it provides such a system wherein: such at least one magnetizer comprises at least one magnetizer bar comprising at least one longitudinal axis; such at least one magnetizer bar comprises a plurality of discrete field-producing lamination-sets spaced along such at least one longitudinal axis; each discrete field-producing lamination-set of such plurality comprises at least one circular magnetic disk and at least one circular flux-conducting spacer magnetically coupled with such at least one circular magnetic disk; and each such at least one circular magnetic disk and each such at least one circular flux-conducting spacer are coaxial with such at least one longitudinal axis. Also, it provides such a system further comprising at least one axial-holder structured and arranged to axially-hold such at least one magnetizer bar along such at least one longitudinal axis.

In addition, it provides such a system further comprising at least one rotary movement generator structured and arranged to generate rotary movement of such at least one axial-holder and such at least one magnetizer bar. And, it provides such a system wherein such at least one magnetizer bar is structured and arranged to magnetically couple to the at least one planar sheet, when the at least one planar sheet is in position to pass through at least one magnetic field produced by such at least one magnetic field source, to transfer movement to the at least one planar sheet. Further, it provides such a system wherein such at least one magnetizer bar is structured and arranged to rotate to move the at least one planar sheet through at least one magnetic field. Even further, it provides such a system further comprising at least one planar sheet decoupler structured and arranged to decouple the at least one planar sheet from such at least one magnetizer bar during movement of the at least one planar sheet through at least one magnetic field. Moreover, it provides such a system wherein, when the at least one planer sheet is in position and coupled to such at least one magnetizer bar, such at least one magnetizer bar is structured and arranged to rotate to move the at least one planar sheet through such at least one magnetic field at a rate from about 10 feet per minute to about 50 feet per minute. Additionally, it provides such a system wherein, when the at least one planer sheet is in position and coupled to such at least one magnetizer bar, such at least one magnetizer bar is structured and arranged to rotate to move the at least one planar sheet through such at least one magnetic field at a rate of at about 15 feet/min.

Also, it provides such a system wherein such at least one sheet decoupler comprises a plurality of decoupler elements. In addition, it provides such a system wherein each of such plurality of decoupler elements are spaced about every inch along such at least one longitudinal axis. And, it provides such a system wherein such at least one sheet decoupler comprises at least one planar rigid decoupler plate. Further, it provides such a system wherein such at least one planar rigid decoupler plate comprises a plurality of apertures structured and arranged to permit protrusion of at least one portion of such at least one magnetizer bar to assist movement of the at least one planar sheet, when the at least one planer sheet is in position and coupled to such at least one magnetizer bar. Even further, it provides such a system wherein such at least one magnetizer bar comprises at least one magnetizer bar set situate partially above and partially below a movement track of the at least one planar sheet. Moreover, it provides such a system wherein such at least one magnetizer bar set comprises at least two magnetizer bar sub-sets, each such magnetizer bar subset comprising: at least one magnetic field source above the movement track; at least one magnetic field source below the movement track; and at least one flux field situate between such at least one magnetic field source above the movement track and such at least one magnetic field source below the movement track; wherein such at least one flux field crosses the movement track.

Additionally, it provides such a system further comprising at least one magnetic field source aligner structured and arranged to align such at least one magnetic field source above the movement track and such at least one magnetic field source below the movement track in such manner as to maximize such at least one flux field crossing the movement track. Also, it provides such a system wherein each upper magnetic field source is encased to provide at least one smooth surface. In addition, it provides such a system wherein an encasing material allows maximum transmission of magnetic field. And, it provides such a system wherein such encasing material comprises brass. Further, it provides such a system wherein such at least one magnetizer bar comprises at least one magnetizer bar set situate below a movement track of the at least one planar sheet. Even further, it provides such a system wherein each such discrete field-producing lamination-set comprises from about 10 to about 20 laminations per inch. Moreover, it provides such a system wherein each such discrete field-producing lamination-set comprises exactly 12 laminations per inch.

Additionally, it provides such a system wherein each such discrete field-producing lamination-set comprises a magnetic field of about 5000 Gauss to about 6000 Gauss. Also, it provides such a system wherein each such discrete field-producing lamination-set comprises exactly 16 laminations per inch. In addition, it provides such a system wherein each such discrete field-producing lamination-set comprises a magnetic field of about 4000 Gauss to about 5000 Gauss. And, it provides such a system wherein such at least one rotary movement generator comprises at least one motor. Further, it provides such a system further comprising: at least one power cord structured and arranged to assist power transfer from at least one external power source to such at least one rotary movement generator; wherein such at least one power cord may be contained within such at least one enclosure when stored. Even further, it provides such a system further comprising at least one mounting member structured and arranged to mount, in at least one operational alignment, such at least one positioner and such at least one magnetizer to such at least one enclosure. Moreover, it provides such a system wherein such at least one mounting member comprises at least one aligning-mounting plate. Additionally, it provides such a system, wherein such at least one aligning-mounting plate comprises such at least one planar rigid decoupler plate. Also, it provides such a system wherein such at least one planar rigid decoupler plate comprises a plurality of apertures structured and arranged to permit protrusion of at least one portion of such at least one magnetizer bar to assist movement of the at least one planar sheet.

In addition, it provides such a system wherein such at least one aligning-mounting plate mounts to such at least one enclosure. And, it provides such a system wherein such at least one aligning-mounting plate divides such at least one enclosure into: at least one operation-isolated-region structured and arranged to assist protection of such at least one magnetizer and such at least one rotary movement generator from external interaction, during operation of such at least one magnetizer; and at least one operation-accessible-region structured and arranged to permit user access during operation of such at least one magnetizer. Further, it provides such a system wherein such at least one enclosure comprises at least one aperture structured and arranged to permit operating power connection between such at least one rotary movement generator and external power source. Even further, it provides such a system wherein such at least one enclosure comprises at least one securable briefcase structured and arranged to provide briefcase securing of such at least one enclosure.

Moreover, it provides such a system wherein such at least one hand-carrier comprises at least one handle. Additionally, it provides such a system further comprising at least one mounting member structured and arranged to mount, in at least one operational alignment, such at least one positioner and such at least one magnetizer to such at least one enclosure. Also, it provides such a system wherein such at least one positioner comprises at least one user-adjustable planar sheet feeder structured and arranged to user-adjustably feed the at least one planar sheet into such at least one magnetizer. In addition, it provides such a system wherein such at least one adjustable planar sheet feeder accepts a sheet width of less than about 13 inches. And, it provides such a system wherein such at least one adjustable planar sheet feeder collapses to allow containment in such at least one enclosure when stored.

In accordance with another preferred embodiment hereof, this invention provides a system, related to magnetization of at least one substantially planar sheet of substantially flexible magnetizable material, such system comprising: at least one first magnetic field source structured and arranged to produce at least one first magnetic field; at least one second magnetic field source structured and arranged to produce at least one second magnetic field; and at least one geometric positioner structured and arranged to geometrically position such at least one first magnetic field source and such at least one second magnetic field source to generate at least one first magnetic-flux field region resulting from at least one magnetic-field interaction between such at least one first magnetic field and such at least one second magnetic field; wherein such at least one first magnetic-flux field region is situate substantially between such at least one first magnetic field source and such at least one second magnetic field source; wherein such at least one geometric positioner comprises at least one passage structured and arranged to allow moving passage of the substantially flexible magnetizable material through such at least one first magnetic-flux field region; at least one enclosure structured and arranged to enclose such at least one first magnetic field source, such at least one second magnetic field source, and such at least one geometric positioner; and at least one hand-carrier structured and arranged to permit hand-carrying of such at least one enclosure.

Further, it provides such a system wherein: such at least one second magnetic field source is structured and arranged to make physical contact with the at least one substantially planar sheet of substantially flexible magnetizable material during passage through such at least one first magnetic-flux field region; and such at least one first magnetic field source is structured and arranged to avoid physical contact with the at least one substantially planar sheet of substantially flexible magnetizable material during passage through such at least one first high-flux field region. Even further, it provides such a system wherein: each of such at least one first magnetic field source and such at least one second magnetic field source comprises at least one magnetizer bar comprising at least one longitudinal axis; such at least one magnetizer bar comprises a plurality of discrete field-producing lamination-sets spaced along such at least one longitudinal axis; each discrete field-producing lamination-set of such plurality comprises at least one circular magnetic disk and at least one circular flux-conducting spacer magnetically coupled with such at least one circular magnetic disk; and each such at least one circular magnetic disk and each such at least one circular flux-conducting spacer are coaxial with such at least one longitudinal axis.

Moreover, it provides such a system further comprising at least one axial-holder structured and arranged to axially-hold such at least one magnetizer bar along such at least one longitudinal axis. Additionally, it provides such a system further comprising at least one rotary movement generator structured and arranged to generate rotary movement of such at least one axial-holder and such at least one magnetizer bar. Also, it provides such a system wherein such at least one magnetizer bar is structured and arranged to magnetically couple to the at least one planar sheet, when the at least one planar sheet is in position to pass through at least one magnetic field produced by such at least one magnetic field source, to transfer movement to the at least one planar sheet. In addition, it provides such a system wherein, when the at least one planer sheet is in position and coupled to such at least one magnetizer bar, such at least one magnetizer bar is structured and arranged to rotate to move the at least one planar sheet through such at least one first magnetic-flux field region. And, it provides such a system further comprising at least one planar sheet decoupler structured and arranged to decouple the at least one planar sheet from such at least one magnetizer bar during movement of the at least one planar sheet through such at least one first magnetic-flux field region. Further, it provides such a system wherein such at least one magnetizer bar is structured and arranged to rotate to move the at least one planar sheet through such at least one first magnetic-flux field region at a rate from about 10 feet per minute to about 50 feet per minute. Even further, it provides such a system wherein such at least one magnetizer bar rotates to move the at least one planar sheet through such at least one first magnetic-flux field region at a rate of at about 15 feet/min.

Even further, it provides such a system wherein such at least one magnetizer bar comprises at least one magnetizing portion comprising from about 10 to about 20 laminations per inch. Even further, it provides such a system wherein such at least one magnetizing portion comprises exactly 16 laminations per inch. Even further, it provides such a system wherein such at least one magnetizing portion comprises a magnetic field of about 4000 Gauss to about 5000 Gauss. Even further, it provides such a system wherein such at least one sheet decoupler comprises at least one planar rigid decoupler plate. Even further, it provides such a system wherein such at least one planar rigid decoupler plate comprises a plurality of apertures structured and arranged to permit protrusion of at least one portion of such at least one magnetizer bar to assist movement of the at least one planar sheet. Even further, it provides such a system wherein such at least one planar rigid decoupler plate mounts to such at least one enclosure.

Even further, it provides such a system wherein such at least one planar rigid decoupler plate divides such at least one enclosure into: at least one operation-isolated-region structured and arranged to assist protection of such at least one magnetizer and such at least one rotary movement generator from external interaction, during operation of such at least one magnetizer; and at least one operation-accessible-region structured and arranged to permit user access during operation of such at least one magnetizer. Even further, it provides such a system further comprising at least one user-adjustable planar sheet feeder structured and arranged to user-adjustably feed the at least one planar sheet through such at least one first magnetic-flux field region. Even further, it provides such a system wherein such at least one adjustable planar sheet feeder accepts a sheet width of less than about 13 inches. Even further, it provides such a system wherein such at least one adjustable planar sheet feeder collapses to allow containment in such at least one enclosure when stored. Even further, it provides such a system further comprising at least one magnetic field source aligner structured and arranged to align such at least one first magnetic field source above the movement track and such at least one second magnetic field source below the movement track in such manner as to maximize such at least one magnetic-flux field region crossing the movement track. Even further, it provides such a system each such at least one first magnetic field source is encased to provide at least one smooth surface. Even further, it provides such a system wherein the encasing material allows maximum transmission of magnetic field. Even further, it provides such a system wherein the encasing material comprises brass. In accordance with another preferred embodiment hereof, this invention provides a briefcase system comprising: at least one briefcase; wherein such at least one briefcase comprises at least one aperture providing access to an interior of such at least one briefcase even when such at least one briefcase is closed.

In accordance with another preferred embodiment hereof, this invention provides a system, relating to enabling magnetization of at least one planar sheet of flexible magnetizable material, such system comprising: at least one magnetizer structured and arranged to magnetize the at least one planar sheet using at least one magnetic field source; and at least one briefcase-type enclosure structured and arranged to enclose such at least one magnetizer; wherein such at least one briefcase-type enclosure comprises at least one handle configured to assist single-hand carrying of such at least one briefcase-type enclosure enclosing such at least one magnetizer; and wherein the at least one planar sheet, when magnetized by such at least one magnetizer, is capable of magnetically adhering to at least one magnetically receptive material.

Moreover, it provides such a system, wherein such at least one magnetizer comprises at least one permanent magnet. Additionally, it provides such a system, wherein: such at least one magnetizer comprises at least one magnetizer bar comprising at least one longitudinal axis; such at least one magnetizer bar comprises a plurality of discrete field-producing lamination-sets spaced along such at least one longitudinal axis; each discrete field-producing lamination-set of such plurality comprises at least one circular magnetic disk and at least one circular flux-conducting spacer magnetically coupled with such at least one circular magnetic disk; and each such at least one circular magnetic disk and each such at least one circular flux-conducting spacer are coaxial with such at least one longitudinal axis. Also, it provides such a system, further comprising: at least one rotary movement generator structured and arranged to generate rotary movement of such at least one magnetizer bar about such at least one longitudinal axis. In addition, it provides such a system, wherein such at least one magnetizer bar is structured and arranged to magnetically couple to the at least one planar sheet, when the at least one planar sheet is in position to pass through at least one magnetic field produced by such at least one magnetic field source, to transfer movement to the at least one planar sheet. And, it provides such a system, wherein such at least one magnetizer bar is structured and arranged to assist movement of the at least one planar sheet through at least one magnetic field by such rotary movement of such at least one magnetizer bar about such at least one longitudinal axis.

Further, it provides such a system, wherein such at least one magnetizer bar comprises at least one magnetizer bar set situate partially above and partially below a movement track of the at least one planar sheet. Even further, it provides such a system, wherein such at least one magnetizer bar set comprises at least two magnetizer bar sub-sets, each such magnetizer bar sub-set comprising: at least one magnetic field source above the movement track; at least one magnetic field source below the movement track; and at least one flux field situate between such at least one magnetic field source above the movement track and such at least one magnetic field source below the movement track; wherein such at least one flux field crosses the movement track. Moreover, it provides such a system, wherein each at least one magnetic field source above the movement track is encased to provide at least one smooth surface.

Additionally, it provides such a system, wherein such at least one magnetizer bar comprises at least one magnetizer bar set situate below a movement track of the at least one planar sheet. Also, it provides such a system, wherein such at least one rotary movement generator comprises: at least one electrical motor; and at least one power cord structured and arranged to assist power transfer from at least one external power source to such at least one electrical motor; wherein such at least one power cord may be contained within such at least one briefcase-type enclosure when stored. In addition, it provides such a system, further comprising: at least one positioner structured and arranged to permit positioning the at least one planar sheet into at least one magnetizing interaction relationship with such at least one magnetizer; wherein such at least one positioner comprises at least one user-adjustable planar sheet feeder structured and arranged to user-adjustably feed the at least one planar sheet into such at least one magnetizer. And, it provides such a system, wherein such at least one adjustable planar sheet feeder accepts a sheet width of less than about 13 inches. Further, it provides such a system, wherein such at least one adjustable planar sheet feeder collapses to allow containment in such at least one enclosure when stored.

Even further, it provides such a system, wherein such at least one rotary movement generator further comprises: In contact with such at least one magnetizer bar, at least one drive roller structured and arranged to generate such rotary movement of such at least one magnetizer bar; wherein such at least one drive roller is operably coupled with such at least one motor. Moreover, it provides such a system, wherein such at least one drive roller comprises at least one resilient contact surface structured and arranged to resiliently contact such at least one magnetizer bar during generation of such rotary movement. Additionally, it provides such a system, wherein: such at least one magnetizer bar comprises at least one magnetizer bar set situate partially above and partially below a movement track of the at least one planar sheet; such at least one magnetizer bar set comprises at least two magnetizer bar sub-sets, each such magnetizer bar sub-set comprising at least one magnetic field source above the movement track, at least one magnetic field source below the movement track, and at least one flux field situate between such at least one magnetic field source above the movement track and such at least one magnetic field source below the movement track; wherein such at least one flux field crosses the movement track.

In accordance with another preferred embodiment hereof, this invention provides a system, related to magnetization of at least one substantially planar sheet of substantially flexible magnetizable material, such system comprising: at least one first magnetic field source structured and arranged to produce at least one first magnetic field; at least one second magnetic field source structured and arranged to produce at least one second magnetic field; and at least one geometric positioner structured and arranged to geometrically position such at least one first magnetic field source and such at least one second magnetic field source to generate at least one first magnetic-flux field region resulting from at least one magnetic-field interaction between such at least one first magnetic field and such at least one second magnetic field; within such at least one geometric positioner, at least one passage structured and arranged to allow moving passage of the substantially flexible magnetizable material through such at least one first magnetic-flux field region; at least one user-adjustable planar sheet feeder structured and arranged to user-adjustably feed the at least one planar sheet through such at least one first magnetic-flux field region; at least one sheet mover to assist movement of the at least one planar sheet through such at least one first magnetic-flux field region; and at least one enclosure structured and arranged to enclose such at least one first magnetic field source, such at least one second magnetic field source, and such at least one geometric positioner; and at least one hand-carrier structured and arranged to assist single-hand carrying of such at least one enclosure; wherein the at least one planar sheet is at least partially magnetized by passage through such at least one first magnetic-flux field region.

Also, it provides such a system, wherein such at least one user-adjustable planar sheet feeder is collapsible to permit closure of such at least one enclosure. In addition, it provides such a system, wherein: each of such at least one first magnetic field source and such at least one second magnetic field source comprises at least one magnetizer bar comprising at least one longitudinal axis; such at least one magnetizer bar comprises a plurality of discrete field-producing lamination-sets spaced along such at least one longitudinal axis; each discrete field-producing lamination-set of such plurality comprises at least one circular magnetic disk and at least one circular flux-conducting spacer magnetically coupled with such at least one circular magnetic disk; and each such at least one circular magnetic disk and each such at least one circular flux-conducting spacer are coaxial with such at least one longitudinal axis. And, it provides such a system, wherein such at least one sheet mover comprises: at least one rotary movement generator structured and arranged to generate rotary movement of such at least one magnetizer bar; wherein such at least one magnetizer bar is structured and arranged to magnetically couple to the at least one planar sheet, when the at least one planar sheet is in position to pass through such at least one first magnetic-flux field region, to transfer movement to the at least one planar sheet.

In accordance with another preferred embodiment hereof, this invention provides a system, relating to enabling magnetization of at least one planar sheet of flexible magnetizable material, such system comprising: magnetizer means for magnetizing the at least one planar sheet using at least one magnetic field source; and enclosure means for enclosing such at least one magnetizer; wherein such enclosure means comprises hand-carrier means for assisting hand-carrying, with one hand, of such enclosure means; wherein the at least one planar sheet, when magnetized by such magnetizer means, is capable of magnetically adhering to at least one magnetically receptive material. In accordance with preferred embodiments hereof, this invention provides, each and every novel feature, element, combination, step and/or method disclosed or suggested by this patent application.

DETAILED DESCRIPTION OF THE BEST MODES AND PREFERRED EMBODIMENTS OF THE INVENTION

Magnetizeable sheets preferably comprise a printable surface that allows them to be printed on by standard printers. These magnetizable sheets can cause problems with printers when they are run through the printer after magnetization, since a magnetic field may interfere with the operability of the printer. One solution to this problem is to print on the printable side of the magnetizable sheets prior to magnetization. The sheets would then not interfere with printer function, and after printing, the sheet may then be run through a magnetizer.

Figure 1:
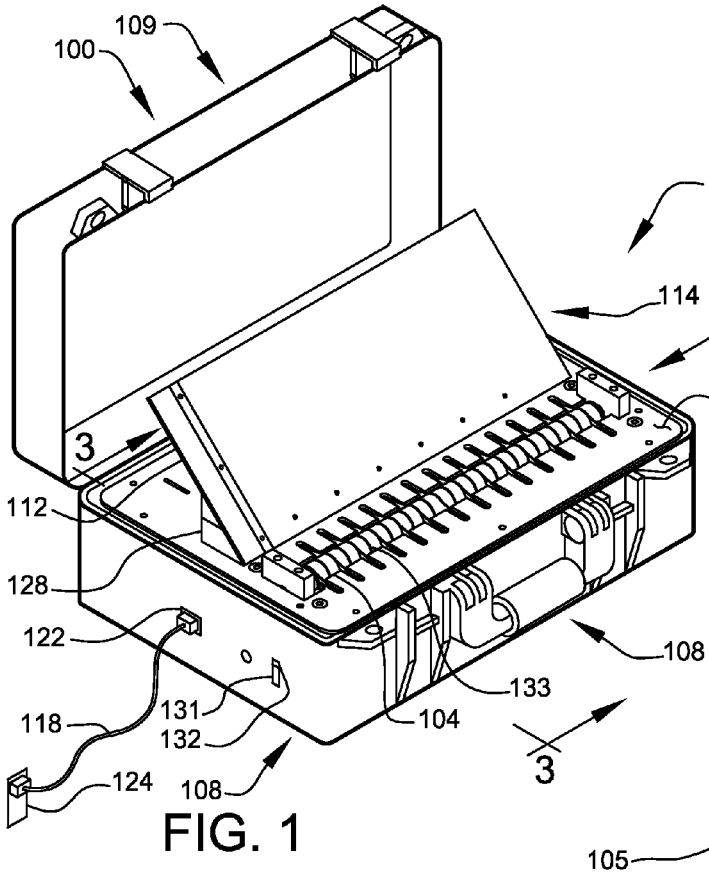
FIG. 1 shows a perspective view, illustrating a preferred portable magnetizer system in at least one preferred operable configuration, according to a preferred embodiment of the present invention.

FIG. 1 shows a perspective view, illustrating a preferred portable magnetizer system 100 in at least one preferred operable configuration 109. Portable magnetizer system 100 preferably provides a solution to the stated problem of portable onsite magnetizing. Portable magnetizer system 100 preferably comprises at least one portable magnetizer 105. Portable magnetizer 105 preferably comprises at least one briefcase enclosure 108. Upon reading the teachings of this specification, those skilled in the art will now appreciate that, under appropriate circumstances, considering such issues as cost, future technologies, etc., other enclosures, such as, for example, box enclosures, top carry enclosures, soft case enclosures, etc., may suffice.

Portable magnetizer 105 preferably comprises at least one magnetizer 101 housed inside briefcase enclosure 108 (at least embodying herein enclosure means for enclosing said magnetizer means and said positioner means; and at least embodying herein at least one enclosure structured and arranged to enclose said at least one magnetizer and said at least one positioning geometry), as shown. Magnetizer 101 (at least embodying herein magnetizer means for providing at least one magnetic field source; and at least embodying herein at least one magnetizer structured and arranged to provide at least one magnetic field source) preferably comprises at least one magnetic roller 133 and at least one feed tray 112 preferably mounted to (see FIG. 10 through FIG. 17) at least one panel 106. Magnetic roller 133 preferably comprises at least one magnetizer array 104. Upon reading the teachings of this specification, those skilled in the art will now appreciate that, under appropriate circumstances, considering such issues as cost, future technologies, etc., other magnetizing arrangements, such as, for example, rollers with separate magnetizer arrays, magnetic bars arrays, dual magnetic field sources, etc., may suffice.

In operable configuration 109, briefcase enclosure 108 is preferably in an open position, as shown. Feed tray 112 is preferably in preferred angled position 114, as shown. At least one power cord 118 (at least embodying herein at least one power cord structured and arranged to assist power transfer from at least one power source to said at least one rotary movement generator) is preferably plugged into at least one power cord receptacle 122 within portable magnetizer 105 and at least one wall outlet 124, as shown. Upon reading the teachings of this specification, those skilled in the art will now appreciate that, under appropriate circumstances, considering such issues as site location, cost, future technologies, etc., other power sources, such as, for example, solar power cells, batteries, vehicle electrical circuits, etc., may suffice.

Figure 2:
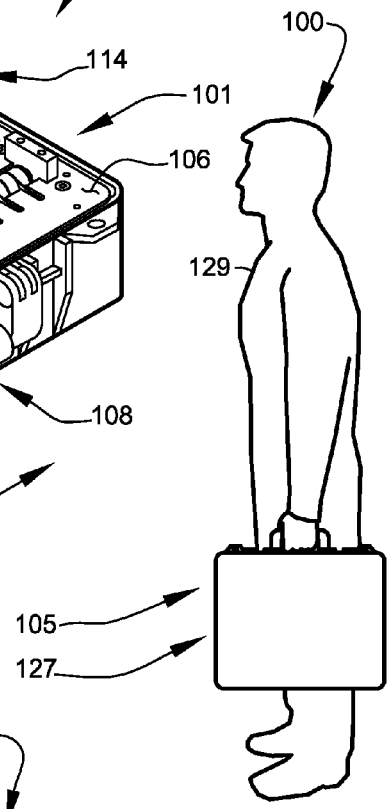
FIG. 2 shows a side view, illustrating a preferred portable magnetizer being carried by a user, according to the preferred embodiment of FIG. 1.

FIG. 2 shows a side view illustrating portable magnetizer 105 being carried by user 129. Portable magnetizer 105 is preferably closed and preferably placed in at least one stowed configuration 127 when not in use, as shown best in FIG. 4 and FIG. 5. Preferred stowed configuration 127 of portable magnetizer 105 preferably assists user 129 to carry portable magnetizer 105, as shown. Portable magnetizer 105 preferably weighs about 25 lbs.

With reference to FIG. 1, as discussed, portable magnetizer 105 is preferably deployed by user 129 to operable configuration 109 prior to use. First, briefcase enclosure 108 is preferably opened, as shown in FIG. 1. Then, feed tray 112 preferably is deployed to angled position 114 using at least one tray mount 128, as discussed in detail with reference to FIGS. 14-17. After plugging in power cord 118, at least one power switch 131 is then preferably turned to "on" position 132. Turning power switch 131 to "on" position 132 preferably activates rotation of magnetic roller 133. Portable magnetizer 105 preferably utilizes standard electrical power (preferably about 115 volts alternating current preferably with about 1.6 amperes of current load).

Figure 3:
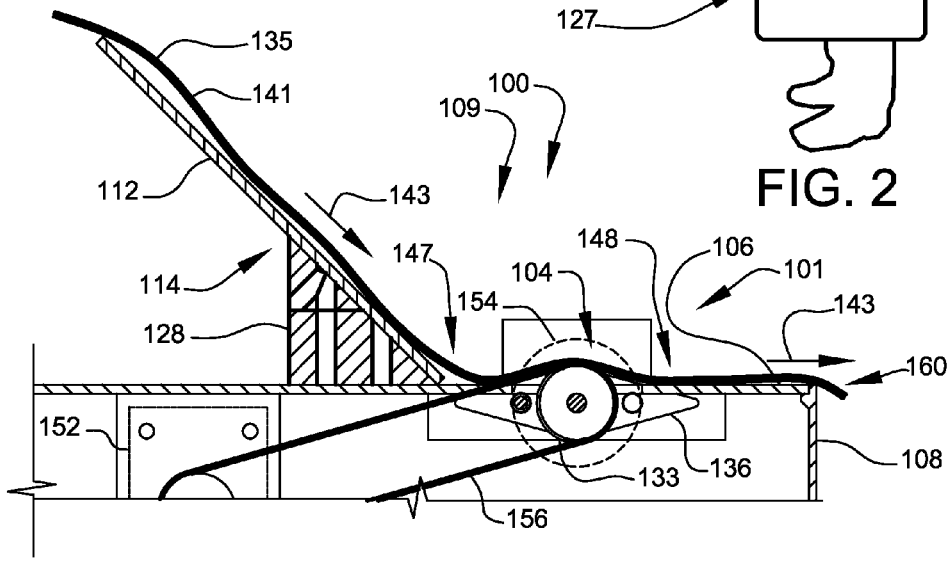
FIG. 3 shows a partial cross-sectional view through the section 3-3 of FIG. 1, illustrating a flexible magnetizable sheet in transit adjacent to a magnetic roller, according to the preferred embodiment of FIG. 1.

FIG. 3 shows a partial cross-sectional view through section 3-3 of FIG. 1, illustrating at least one flexible magnetizable sheet 141 in transit adjacent to magnetic roller 133, according to the preferred embodiment of FIG. 1. Flexible magnetizable sheet 141 is preferably loaded into feed tray 112. Flexible magnetizable sheet 141 is preferably loaded with printed side 135 facing away from feed tray 112 (at least embodying herein positioning geometry means for permitting positioning the at least one substantially planar sheet in at least one magnetizing interaction relationship with said at least one magnetizer means; and at least embodying herein at least one positioning geometry structured and arranged to permit positioning the at least one substantially planar sheet in at least one magnetizing interaction relationship with said at least one magnetizer). Magnetic roller 133 preferably pulls, preferably through rotation and magnetic coupling, flexible magnetizable sheet 141 from feed tray 112 (this arrangement at least herein embodying wherein said at least one magnetizer bar magnetically couples to the at least one substantially planar sheet to transfer movement to the at least one substantially planar sheet). Magnetic roller 133 then preferably drives, preferably through rotation and magnetic coupling, flexible magnetizable sheet 141 along at least one feed path 143, as shown. Magnetic roller 133 preferably runs between about 10 feet/min and about 50 feet/min, preferably at about 15 feet/min (this arrangement at least herein embodying wherein said at least one magnetizer bar rotates to move the at least one substantially planar sheet through said at least one magnetizer at a rate from about 10 feet/min to about 50 feet/min; and this arrangement at least herein embodying wherein said at least one magnetizer bar rotates to move the at least one substantially planar sheet through said at least one magnetizer at a rate of at about 15 feet/min).

Magnetizer array 104 comprises a length of about 13 inches, preferably allowing portable magnetizer 105 to magnetize flexible magnetizable sheet 141 comprising less than about 13 inches in width (this arrangement at least herein embodying wherein said at least one adjustable planar sheet feeder accepts a width of the at least one substantially planar sheet of less than about 13 inches). Upon reading the teachings of this specification, those skilled in the art will now appreciate that, under appropriate circumstances, considering such issues as cost, future technology, etc., other magnetizer array lengths, such as, for example, 24 inches, 10 inches, 10 cm, etc., may suffice.

Magnetizer array 104 preferably comprises at least one stripper plate 136. Stripper plates 136 in magnetizer array 104 preferably guide flexible magnetizable sheet 141 over the magnetic roller 133. Stripper plates 136 are preferably shaped to allow flexible magnetizable sheet 141 to be preferably guided on entry side 147 and off exit side 148 of magnetic roller 133.

Magnetic roller 133 preferably couples with and preferably moves flexible magnetizable sheet 141 over magnetizer array 104 preferably by rotation and magnetic coupling as previously stated. At least one motor 152 and at least one chain drive 156 preferably provide rotary movement of magnetic roller 133. In the process of passing over magnetizer array 104, flexible magnetizable sheet 141 is preferably magnetized by at least one magnetic field 154 from magnetic roller 133. (Magnetic roller 133 components will be discussed in more detail in FIG. 6 through FIG. 9.) Flexible magnetizable sheet 141 is preferably moved along feed path 143 to exit side 148 of magnetic roller 133, preferably guided by stripper plates 136. Stripper plates 136 (at least embodying herein at least one sheet decoupler structured and arranged to decouple the at least one substantially planar sheet from said at least one magnetizer bar during movement of the at least one substantially planar sheet through said at least one magnetizer) preferably de-couple flexible magnetizable sheet 141 from magnetic roller 133, during operation. Flexible magnetizable sheet 141 preferably moves from exit side 148 of magnetic roller 133 to panel 106. Flexible magnetizable sheet 141 then preferably moves off at least one edge 160 of briefcase enclosure 108.

Upon reading this specification, those with ordinary skill in the art will now appreciate that, under appropriate circumstances, considering such issues as design preference, user preferences, marketing preferences, cost, structural requirements, available materials, technological advances, etc., other magnetic field generator arrangements such as, for example, solenoids, Helmholtz coils, bar magnets, iron core solenoids, electromagnets, or other magnetic generator technologies, etc., may suffice.

Figure 4:
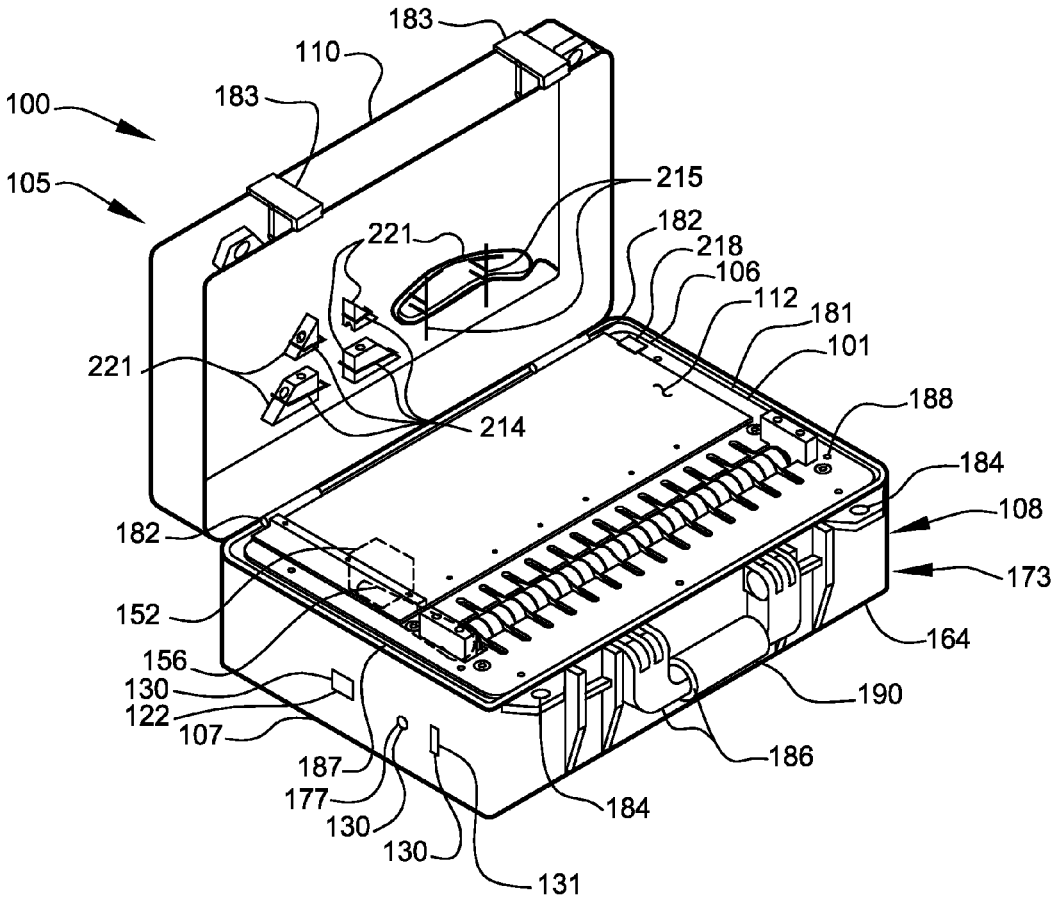
FIG. 4 shows a perspective view, illustrating a briefcase enclosure in an open position with loose items and a feed tray secured therein, according to the preferred embodiment of FIG. 3.

FIG. 4 shows a perspective view illustrating briefcase enclosure 108 in open position 110 with loose items 221 and feed tray 112 secured therein. Briefcase enclosure 108 preferably comprises at least one Pelican model 1500 case 107. Pelican model 1500 case 107 is available from Pelican Products, Inc., located at 23215 Early Avenue, Torrance, Calif. 90505 (Tel. 310-326-4700) or from www.pelican.com on the Internet. Briefcase enclosure 108 preferably comprises at least one seal 181, preferably at least one hinge 182, preferably at least one latch 183, preferably at least one padlock hole 184 and preferably at least one handle 186 (at least embodying herein hand-carrier means for permitting hand carrying of said enclosure means; and at least embodying herein at least one hand-carrier element structured and arranged to permit hand carrying of said at least one enclosure).

Seal 181 preferably comprises at least one O-ring seal, preferably following along the perimeter of briefcase enclosure 108, as shown. Latch 183 preferably comprises at least one double throw latch, as shown. Padlock hole 184 preferably comprises at least one reinforced padlock hole, preferably at least one stainless steel reinforced padlock hole, as shown. Handle 186 preferably comprises at least one molded handle. Handle 186 preferably comprises at least one rubber padding 190.

Briefcase enclosure 108 preferably comprises at least one continuous panel flange 187 with pre-drilled holes 188 to preferably receive and mount panel 106. Panel 106, which preferably mounts to panel flange 187, preferably comprises magnetizer array 104, feed tray 112, and motor 152. Briefcase enclosure 108 also preferably comprises accessory openings 130 (at least herein embodying wherein said at least one briefcase comprises at least one aperture providing access to an interior of said at least one briefcase even when said at least one briefcase is closed; and at least herein embodying wherein said at least one enclosure comprises at least one aperture structured and arranged to permit operating power connection between said at least one rotary movement generator and external power source) to receive power switch 131, power cord receptacle 122 and at least one fuse 177.

Briefcase enclosure 108 preferably serves several functions for portable magnetizer 105. Briefcase enclosure 108 preferably houses magnetizer 101, preferably keeping motor 152 and chain drive 156 contained (as well as guarded for safety during operation), as shown (see also FIG. 3). Panel 106 and at least one lower portion 173 of briefcase enclosure 108 preferably make up at least one housing 164 (at least embodying herein at least one operation-isolated-region structured and arranged to assist protection of said at least one magnetizer and said at least one rotary movement generator from external interaction, during operation of said at least one magnetizer). Motor 152 and chain drive 156 are preferably contained while in operable configuration 109 (see FIG. 1) or in stowed configuration 127 (see FIG. 5).

Another function of the briefcase enclosure 108 is to preferably secure loose items 221. Loose items 221 are items within portable magnetizer system 100, which when not secured, could damage magnetizer 101 during movement or relocation of portable magnetizer 105. Loose items 221 preferably include tray mounts 128 and power cord 118. Loose items 221 are preferably secured by at least one user 129 configuring briefcase enclosure 108 to stowed configuration 127 (see FIG. 5). In stowed configuration 127; tray mounts 128, power cord 118, and feed tray 112 are preferably secured (this arrangement at least herein embodying wherein said at least one power cord may be contained in said at least one enclosure when stored). Feed tray 112, preferably collapses to position shown in FIG. 4 when being stored or transported (this arrangement at least herein embodying wherein said at least one adjustable planar sheet feeder collapses to allow containment in said at least one enclosure when stored). Briefcase enclosure 108 preferably comprises at least one storage mount 214 for tray mounts 128 and at least one storage mount 215 for power cord 118. Additionally, feed tray 112 is preferably secured with at least one lock down mechanism 218 to preferably prevent movement of feed tray 112 while in stowed configuration 127. Securing previously mentioned loose items 221 preferably prevents damage to magnetizer 101. Upon reading the teachings of this specification, those skilled in the art will now appreciate that, under appropriate circumstances, considering such issues as cost, future technology, etc., other loose item securing devices, such as, for example, cord retractors, collapsible tray mounts, spring locks, molded forms, molded foams, etc., may suffice.

Figure 5:
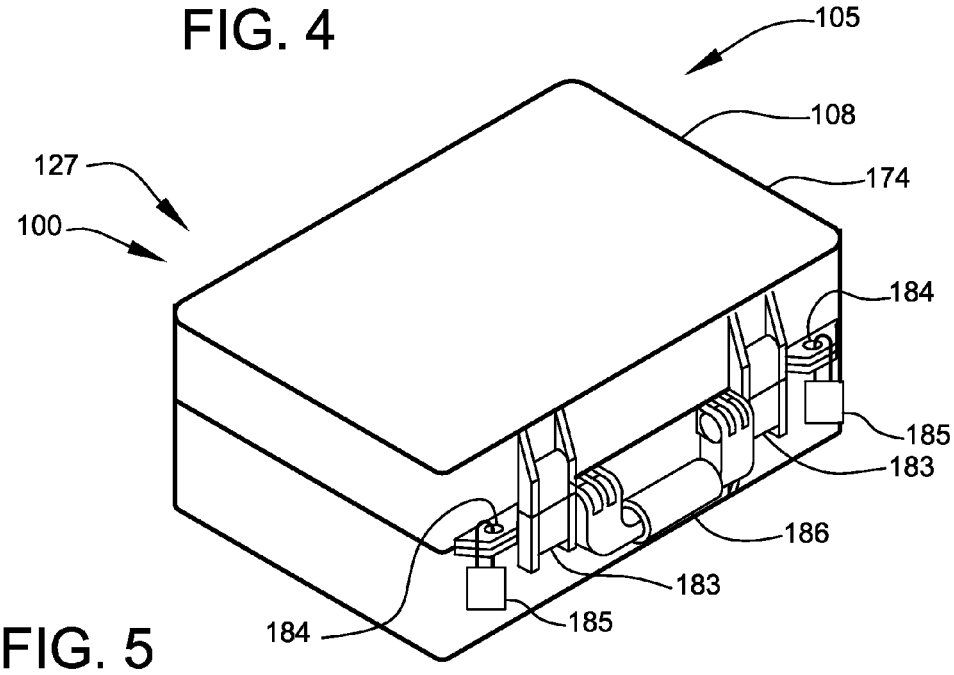
FIG. 5 shows a perspective view illustrating such briefcase enclosure in a stowed configuration, according to the preferred embodiment of FIG. 4.

FIG. 5 shows a perspective view illustrating briefcase enclosure 108 in stowed configuration 127. Another function of briefcase enclosure 108 is to preferably make portable magnetizer 105 portable, secure, and easily storable. Portable magnetizer 105 becomes portable, secure, and easily storable when transitioned to stowed configuration 127, as shown. When user is ready to transition briefcase enclosure 108 to stowed configuration 127, loose items 221 are secured as previously mentioned (see FIG. 4). Briefcase lid 174 is then preferably closed and latched with latches 183. At least one padlock 185 are then preferably inserted into padlock hole 184 and locked. User 129 preferably carries briefcase enclosure 108 by preferably grasping handle 186 as shown in FIG. 2. This arrangement at least herein embodies wherein said enclosure means comprises securable briefcase means for providing briefcase securing of said enclosure means; and this arrangement at least herein embodies wherein said at least one enclosure comprises at least one securable briefcase structured and arranged to provide briefcase securing of said at least one enclosure.

Stowed configuration 127 reduces the size of the portable magnetizer 105, making it smaller for storage. Stowed configuration 127 of briefcase enclosure 108 also preferably allows for simplified handling and moving of portable magnetizer 105 by configuring the portable magnetizer 105 into a manageable size that can be easily held by handle 186 (at least herein embodying wherein said at least one hand-carrier element comprises at least one handle). In addition, padlock 185 adds security to portable magnetizer 105 by controlling access to briefcase enclosure 108.

Upon reading this specification, those with ordinary skill in the art will now appreciate that, under appropriate circumstances, considering such issues as design preference, user preferences, marketing preferences, cost, structural requirements, available materials, technological advances, etc., other enclosure arrangements such as, for example, custom case designs, OEM preconfigured briefcases, or cases made of alternate materials (such as steel, aluminum, wood, or wireframe), etc., may suffice.

Figure 6:
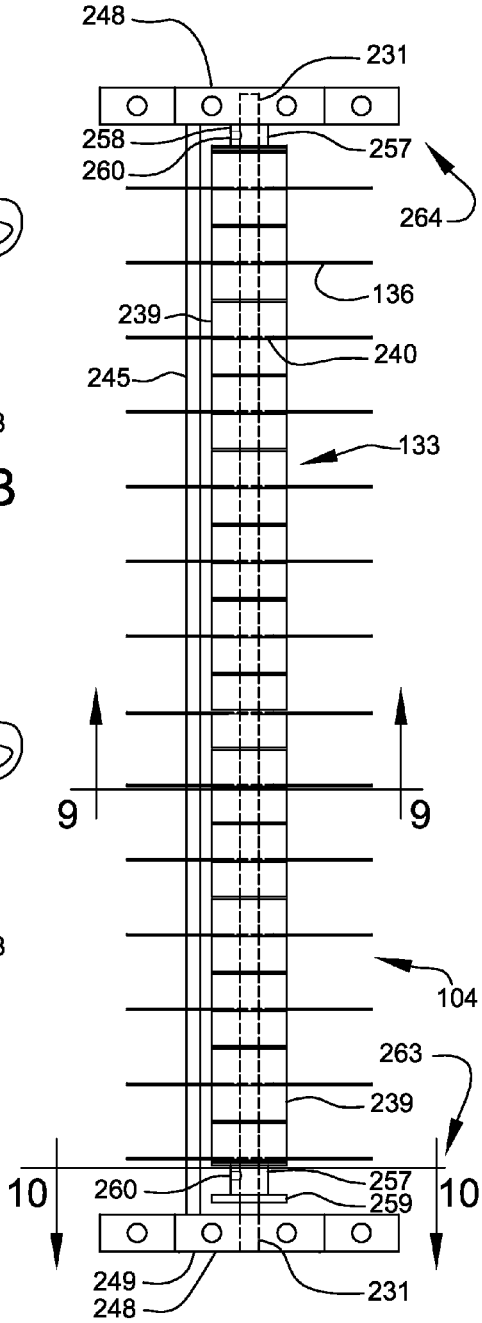
FIG. 6 shows a top view, illustrating at least one magnetizer array with array mounts, according to the preferred embodiment of FIG. 1.

FIG. 6 shows a top view illustrating magnetizer array 104 with array mounts 248. Magnetizer 101, as shown (see FIG. 1) preferably comprises magnetizer array 104, as shown (see FIG. 6). Magnetizer array 104 preferably comprises a magnetic roller 133 as previously mentioned. Magnetic roller 133 is preferably 1" in diameter. Magnetic roller 133 preferably comprises at least one magnetic stack 239, preferably a plurality of magnetic stacks 239.

Magnetic roller 133 preferably comprises at least one shaft 231. Shaft 231 preferably rotates magnetic stacks 239 of magnetic roller 133, during operation. Shaft 231 and thereby magnetic stacks 239 of magnetic roller 133 are preferably rotated by motor 152 (at least embodying herein rotary movement generator means for generating rotary movement of said axial-holder means; and at least embodying herein at least one rotary movement generator structured and arranged to generate rotary movement of said at least one axial-holder and said at least one magnetizer bar, and at least herein embodying wherein said at least one rotary movement generator comprises at least one motor) and chain drive 156, during operation. Rotation of magnetic roller 133 preferably moves flexible magnetizable sheet 141 over magnetizer array 104 as previously stated. Magnetic field 154 of magnetic roller 133 preferably induces a magnetic field (and magnetic alignment) in flexible magnetizable sheet 141 as it passes over the magnetic roller 133. Flexible magnetic sheet 141 preferably retains at least one portion of this magnetic alignment and thereby becomes magnetized.

Stripper plates 136 are preferably spaced about 1 inch apart along shaft 231 between magnetic stacks 239 (at least herein embodying wherein said at least one magnetizer bar comprises a set of discrete field-producing laminations spaced substantially along said at least one longitudinal axis; and this arrangement at least herein embodying wherein said at least one sheet decoupler comprises a plurality of decoupler elements; and this arrangement at least herein embodying wherein said plurality of decoupler elements are spaced about every inch along said at least one longitudinal axis), as shown. Magnetizer array 104 preferably comprises at least one stabilizer bar 245 that runs between array mounts 248. Stabilizer bar 245 preferably stabilizes stripper plates 136, and preferably prevents rotation of stripper plates 136, during operation. Further, stabilizer bar 245 preferably positions stripper plates 136 to optimize operation of magnetizer 101.

Figure 7A:
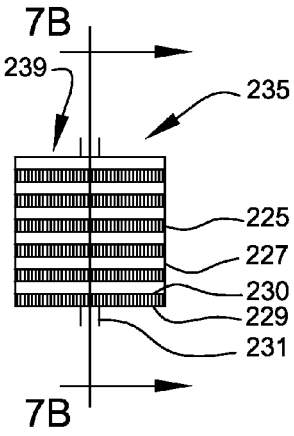
FIG. 7A shows an enlarged top view, illustrating a preferred magnetic stack, according to a preferred embodiment of the present invention.

FIG. 7A shows an enlarged top view, illustrating a preferred magnetic stack, according to a preferred embodiment of the present invention. Magnetic stack 239 preferably comprises disk magnets 225 (at least herein embodying wherein said at least one magnetic field source comprises at least one permanent magnet) as shown, alternately interspersed with steel washers 227 along shaft 231 (at least embodying herein axial-holder means for axially-holding said magnetizer means along a single longitudinal axis; and at least embodying herein at least one axial-holder structured and arranged to axially-hold said at least one magnetizer bar along said at least one longitudinal axis; and this arrangement at least herein embodying wherein said at least one magnetic field source comprises at least one magnetizer bar comprising at least one longitudinal axis; and this arrangement at least herein embodying wherein each discrete field-producing lamination of said set comprises at least one substantially circular magnetic disk magnetically coupled with at least one substantially circular flux-conducting spacer). Disk magnets 225 are preferably arranged with all like poles facing the same direction so as to alternate positive poles 229 and negative poles 230, along magnetic stack 239. Upon reading the teachings of this specification, those skilled in the art will now appreciate that, under appropriate circumstances, considering such issues as cost, future technologies, etc., other magnet arrangements, such as, for example, segmented disk magnets, mono-pole magnets, intrinsically layered magnets, etc., may suffice.

Magnetic stack 239 preferably comprises a diameter of about 1 inch. Magnetic stack 239 preferably comprises a length of about 1 inch. Upon reading the teachings of this specification, those skilled in the art will now appreciate that, under appropriate circumstances, considering such issues as cost, configuration, future technologies, etc., other dimensions, such as, for example, 2 inches, 1 foot, 5 cm, etc., may suffice.

Magnetic stack 239 preferably comprises a 12-PPI (poles per inch) stack 235 (herein sometimes referred to as PPI stack). 12-PPI stack 235 preferably is set on shaft 231. 12-PPI stack 235 preferably comprises 12 disk magnets 225 and preferably 12 steel washers 227 per inch (this arrangement at least herein embodying wherein said at least one magnetizer bar comprises exactly 12 of said discrete field-producing laminations per inch). 12-PPI stack 235 preferably comprises a magnetic field, preferably between about 5000 gauss and 6000 gauss (at least herein embodying wherein said at least one magnetizer bar comprises a magnetic field from about 5000 Gauss to about 6000 Gauss).

Figure 7B:
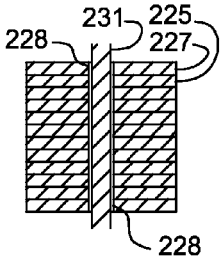
FIG. 7B shows a sectional view through the section 7B-7B of FIG. 7A, illustrating a 12-PPI stack set on a shaft.

FIG. 7B shows a sectional view through the section 7B-7B of FIG. 7A, illustrating 12-PPI stack 235 set on shaft 231. Disk magnets 225 and steel washers 227, preferably have at least one center hole 228 permitting placement over shaft 231.

Figure 8A:
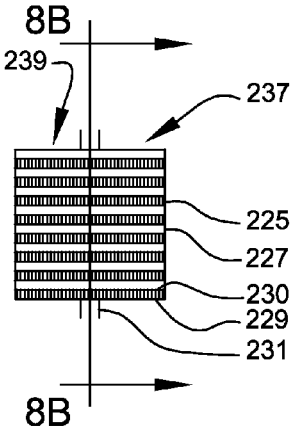
FIG. 8A shows an enlarged top view, illustrating an alternately preferred magnetic stack, according to a preferred embodiment of the present invention.
Figure 8B:
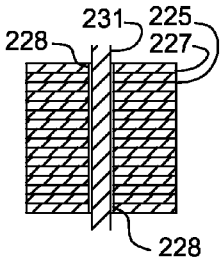
FIG. 8B shows a sectional view through the section 8B-8B of FIG. 8A, illustrating a 16-PPI stack set on a shaft.

FIG. 8A shows an enlarged top view, illustrating an alternately preferred embodiment of magnetic stack 239, according to a preferred embodiment of the present invention. FIG. 8B shows a sectional view through the section 8B-8B of FIG. 8A illustrating a 16-PPI stack 237 set on shaft 231. Alternately, magnetic stack 239 preferably comprises 16-PPI stack 237. 16-PPI stack 237 preferably comprises 16 disk magnets 225 and preferably 16 steel washers 227 per inch (this arrangement at least herein embodying wherein said at least one magnetizer bar comprises exactly 16 of said discrete field-producing laminations per inch). 16-PPI stack 237 preferably comprises a magnetic field, preferably between about 4000 Gauss and about 5000 Gauss (at least herein embodying wherein said at least one magnetizer bar comprises a magnetic field from about 4000 Gauss to about 5000 Gauss).

Figure 9:
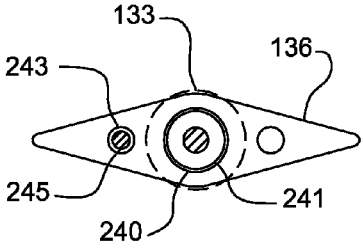
FIG. 9 shows a sectional view through the section 9-9 of FIG. 6, illustrating a stripper plate with a small-diameter washer, shaft, and a stabilizer bar.

FIG. 9 shows a sectional view through section 9-9 of FIG. 6, illustrating stripper plate 136 with at least one small-diameter washer 241, shaft 231, and at least one stabilizer bar 245. Stripper plates 136 preferably comprise a center hole 240 to allow for at least one small-diameter washer 241. Small-diameter washer 241 preferably fits on shaft 231, preferably inside center hole 240 of stripper plates 136. Small-diameter washer 241, preferably made of steel, preferably provides spacing clearance between rotating portions of magnetic roller 133 and stripper plates 136. Small-diameter washer 241 preferably spaces the stripper plate from shaft 231, as well as preferably isolates stripper plates 136 from shaft 231 rotation. In addition, small-diameter washer 241 preferably is slightly thicker than stripper plate 136, preferably to space stripper plate 136 away from magnetic stack 239 on either side. Stripper plates 136 preferably do not rotate during operation of magnetizer 101.

Stabilizer bar 245 preferably runs through at least one stabilizer-bar hole 243 in stripper plates 136. At least one stabilizer bar 245 preferably connects to array mount 248 at each end of magnetizer array 104 (see FIG. 6), preferably at least one stabilizer-bar mounting hole 253 (see FIG. 10).

Stabilizer bar 245, along with small-diameter washer 241, preferably prevents stripper plates 136 from rotating. Stripper plates 136 are preferably held by stabilizer bar 245 to counter rotation of shaft 231, and magnetic roller 133, during operation of magnetizer 101. Stripper plates 136 are preferably stabilized by stabilizer bar 245 allowing stripper plates 136 to preferably guide flexible magnetizable sheet 141 over the magnetic roller 133 as previously mentioned in FIG. 3.

Endplates 257 are preferably mounted on both sides of shaft 231 to preferably hold the magnetic stacks 239, stripper plates 136, and small-diameter washers 241, on shaft 231, as shown in FIG. 6. Endplates 257 preferably comprise at least one endplate locking-screw 260. Endplate locking-screw 260 preferably secures endplates 257 to shaft 231. Endplates 257 preferably apply pressure to transfer rotation of shaft 231 to magnetic stacks 239, and small-diameter washers 241. Upon reading the teachings of this specification, those skilled in the art will now appreciate that, under appropriate circumstances, considering such issues as cost, future technologies, etc., other rotation transfer devices, such as, for example, key shafts, locking screws, adhesives, etc., may suffice.

At least one gear-drive endplate 259 is preferably located on shaft 231 at motor side 263 of magnetizer array 104. Gear-drive endplate 259 preferably provides connection of shaft 231 to chain drive 156 and motor 152, as discussed in detail with reference to FIGS. 18-19. At least one opposed endplate 258 is preferably located on shaft 231 at non-motor side 264 of magnetizer array 104.

Upon reading this specification, those with ordinary skill in the art will now appreciate that, under appropriate circumstances, considering such issues as design preference, user preferences, marketing preferences, cost, structural requirements, available materials, technological advances, etc., other magnetizer holding arrangements such as, for example, non circular shafts, cable shafts, or non-shaft magnetizer, etc., may suffice.

Figure 10:
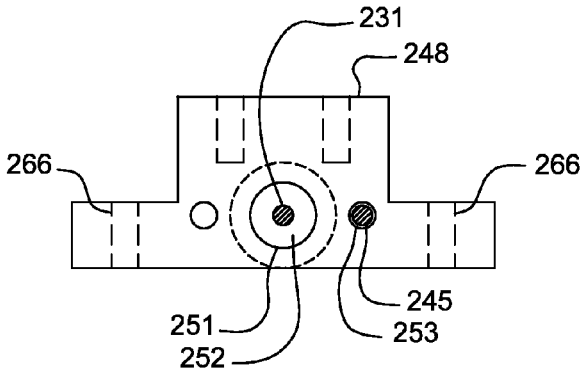
FIG. 10 shows a sectional view through the section 10-10 of FIG. 6, illustrating at least one array mount.

FIG. 10 shows a sectional view through the section 10-10 of FIG. 6, illustrating array mount 248. Array mount 248 preferably comprises at least one shaft-hole 251. At least one low-friction bearing 252 is preferably set into shaft-hole 251 by tight friction fit. Shaft 231, with magnetizer array 104, is preferably set into low-friction bearing 252. Upon reading the teachings of this specification, those skilled in the art will now appreciate that, under appropriate circumstances, considering such issues as cost, future technology, etc., other rotating shaft mountings, such as, for example, rotating end-plates, coaxial bearings, lubricated joints, etc., may suffice.

Array mount 248 also preferably comprise threaded holes 266. Threaded holes 266 preferably receive array mount bolts 267 as shown best in FIGS. 11-13 to secure array mount 248 to panel 106. Upon reading the teachings of this specification, those skilled in the art will now appreciate that, under appropriate circumstances, considering such issues as cost, future technology, materials, etc., other fasteners, such as, for example, rivets, pins, adhesives, etc., may suffice.

Array mount 248 preferably comprises stabilizer-bar mounting hole 253. Stabilizer-bar mounting hole 253 preferably accepts end of stabilizer bar 245. Upon reading the teachings of this specification, those skilled in the art will now appreciate that, under appropriate circumstances, considering such issues as cost, future technology, materials, etc., other stabilizer bar mountings, such as, for example, end bolts, adhesives, brackets, etc., may suffice.

With reference to FIG. 10, array mount 248 is preferably set on shaft 231 of magnetizer array 104. Low friction bearing 252 preferably allow magnetic roller 133 to rotate freely between array mounts 248.

Figure 11:
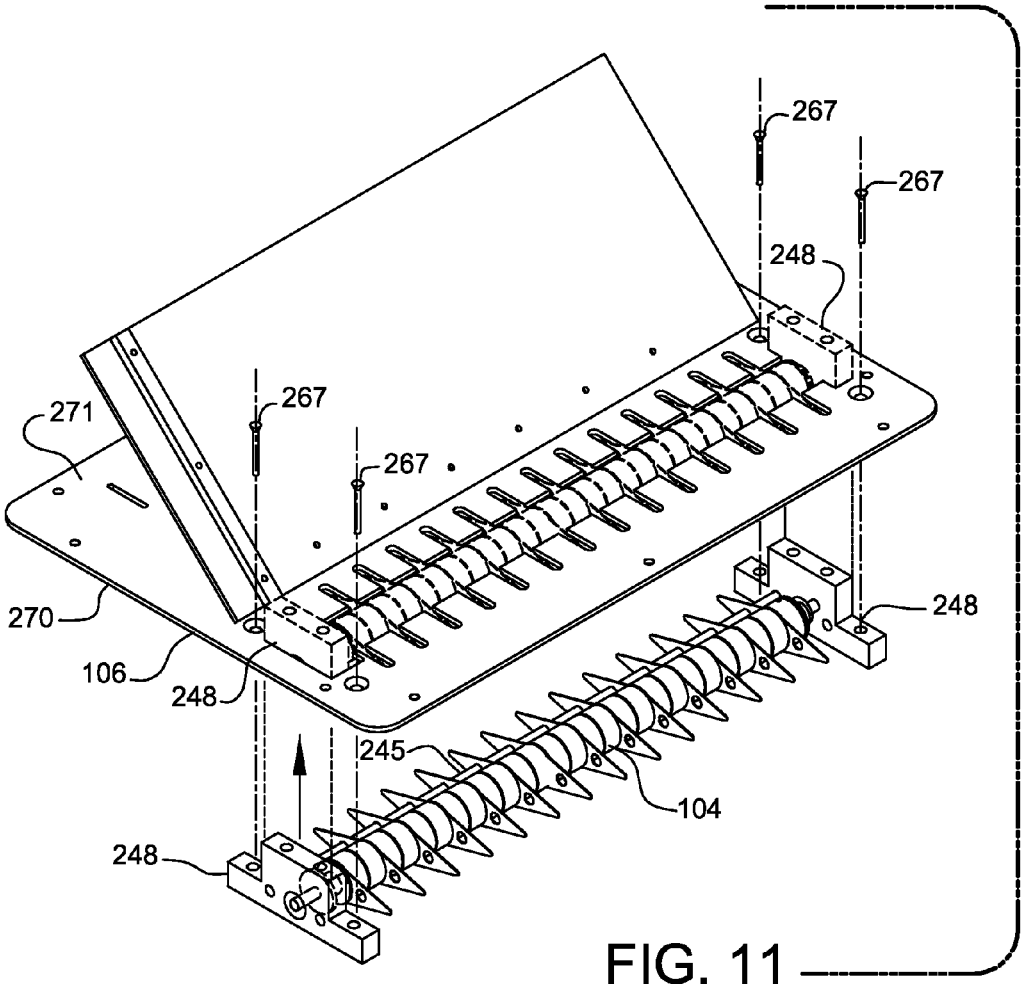
FIG. 11 shows an isometric exploded view, illustrating at least one magnetizer array assembly, according to the preferred embodiment of FIG. 10.

FIG. 11 shows an isometric exploded view, illustrating at least one magnetizer array assembly 205, according to the preferred embodiment of FIG. 10. Magnetizer array assembly 205 preferably comprises magnetizer array 104 preferably attaching to underside 270 of panel 106 with array mount 248. Array mounts 248, along with magnetizer array 104, preferably are joined to underside 270 of panel 106. Array mounts 248 are preferably bolted to panel 106 (at least embodying herein at least one mounting member structured and arranged to mount, in at least one operational alignment, said at least one positioner and said at least one magnetizer to said at least one enclosure) with array mount bolts 267.

Figure 12:
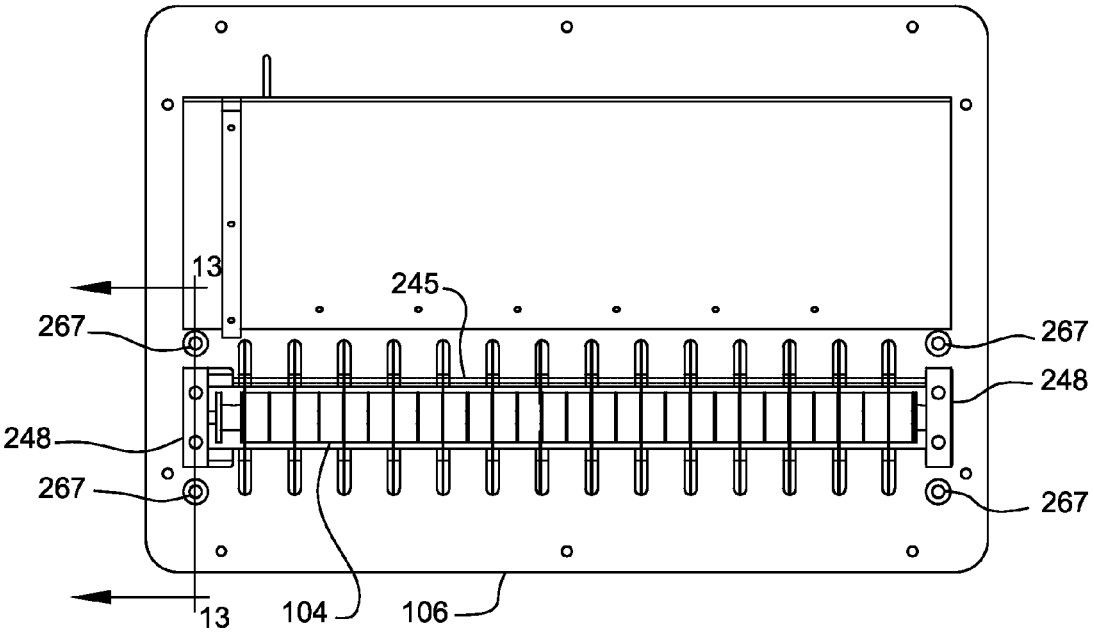
FIG. 12 shows a top view, illustrating such at least one magnetizer array attached to such panel, according to the preferred embodiment of FIG. 11.
Figure 13:
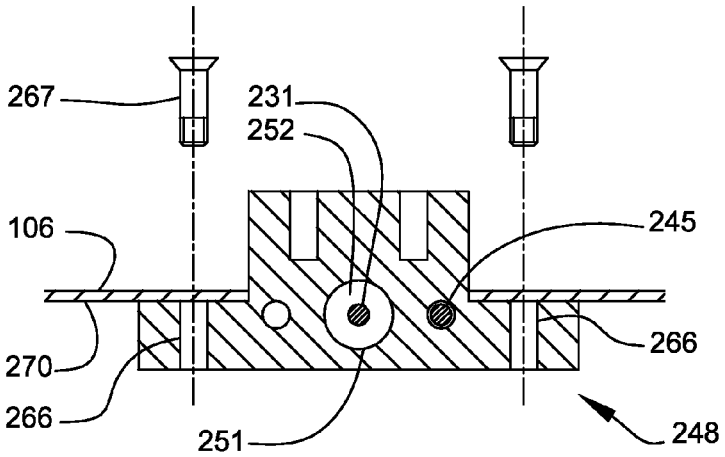
FIG. 13 shows a partial sectional view through the section 13-13 of FIG. 12, illustrating such at least one array mount attachment to such panel, according to the preferred embodiment of FIG. 12.

FIG. 12 shows a top view, illustrating magnetizer array 104 attached to panel 106, according to the preferred embodiment of FIG. 11. FIG. 13 shows a partial sectional view through the section 13-13 of FIG. 12, illustrating array mount 248 attachment to panel 106, according to the preferred embodiment of FIG. 12.

Array mounts 248 preferably hold magnetizer array 104 to panel 106. Mounting magnetizer array 104 to panel 106 preferably stabilizes gear-drive endplate 259. As previously stated, gear drive-endplate 259 is preferably driven by chain drive 156 and motor 152 (see FIG. 19) to rotate the magnetic roller 133. Array mounts 248 also preferably hold magnetizer array 104 in alignment with feed tray 112.

Upon reading this specification, those with ordinary skill in the art will now appreciate that, under appropriate circumstances, considering such issues as design preference, user preferences, marketing preferences, cost, structural requirements, available materials, technological advances, etc., other shaft holding arrangements such as, for example, mounting array mounts to top of panel (instead of bottom location of panel as indicated in this specification), array mounts molded in to panel, direct mounting of magnetizer to panel, or mounting magnetizer directly to portable briefcase enclosure, etc., may suffice.

Figure 14:
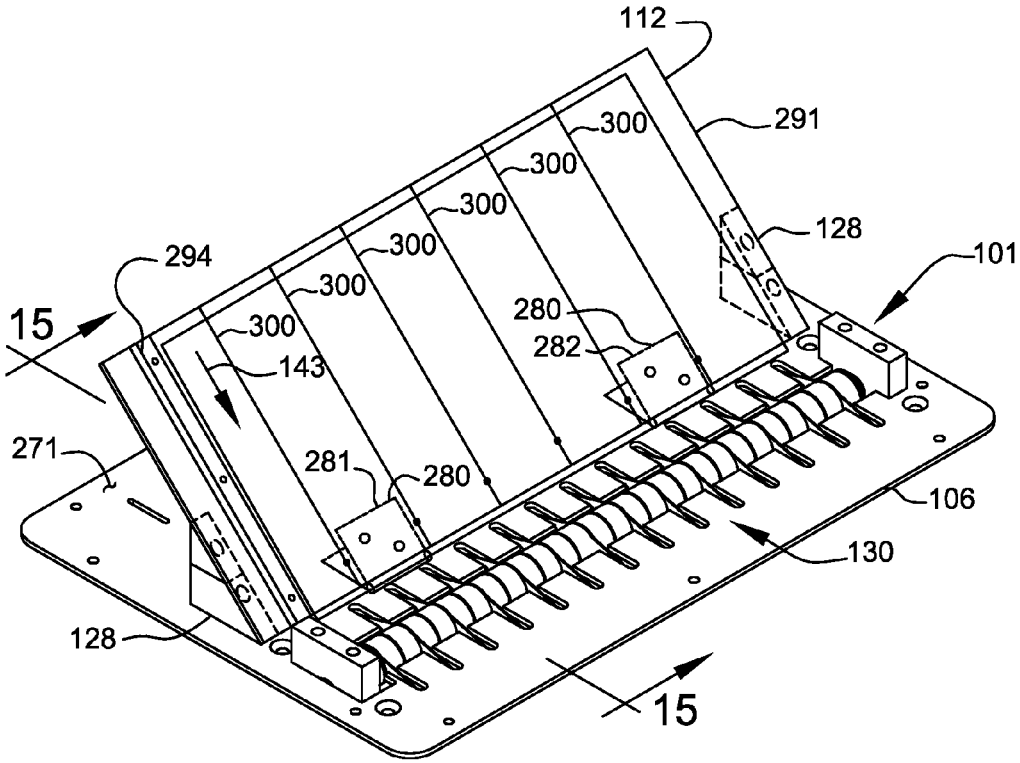
FIG. 14 shows an isometric view, illustrating the feed tray mounted to such panel, according to the preferred embodiment of FIG. 13.

FIG. 14 shows an isometric view, illustrating feed tray 112 mounted to panel 106, according to the preferred embodiment of FIG. 13. Feed tray 112 preferably comprises at least one feed-tray panel 291, which preferably comprises steel. Feed tray 112 further comprises at least one adjustable guide 294, which also preferably comprises of steel. Upon reading the teachings of this specification, those skilled in the art will now appreciate that, under appropriate circumstances, considering such issues as cost, future technologies, etc., other materials, such as, for example, wood, plastics, other metals, etc., may suffice.

Figure 17:
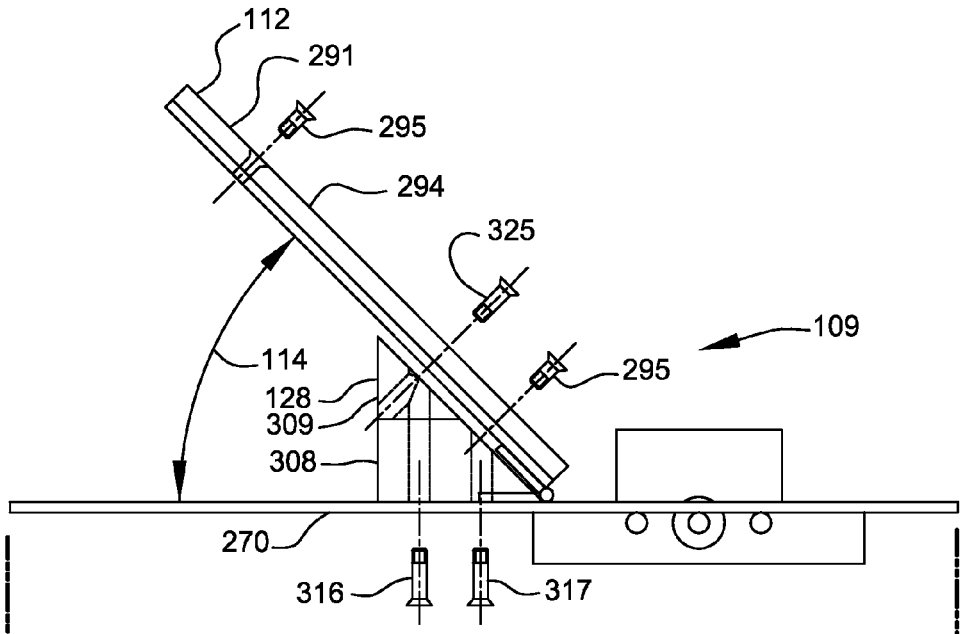
FIG. 17 shows a side view of the magnetizer, illustrating the feed tray and tray mounts deployed to an operable position, according to the preferred embodiment of FIG. 16.

Adjustable guide 294 is preferably attached to feed-tray panel 291 with counter-sink screws 295 (see FIG. 17). Adjustable guide 294 is preferably mounted on feed tray 112 in at least one of variable positions 300 to assist feeding flexible magnetizable sheet 141 straight across magnetic roller 133 (this arrangement herein embodying wherein said at least one positioning geometry comprises at least one user-adjustable planar sheet feeder structured and arranged to user-adjustably feed the at least one substantially planar sheet into said at least one magnetizer). User 129 preferably locates adjustable guide 294 as required at one of variable positions 300 on feed tray 112. User 129 preferably attaches adjustable guide 294 as required.

Figure 15:
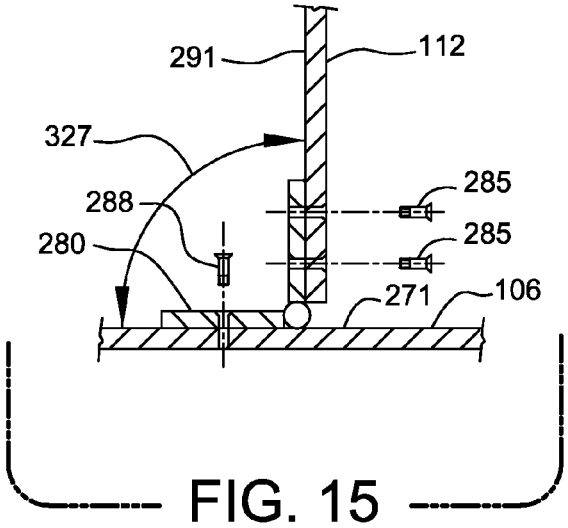
FIG. 15 shows an enlarged partial cross-section through the section 15-15 of FIG. 14, illustrating at least one hinge attaching feed tray to such panel.

FIG. 15 shows an enlarged partial cross-section through section 15-15 of FIG. 14, illustrating at least one hinge attaching feed tray 112 to panel 106. Feed tray 112 is preferably attached to panel 106 with at least one feed-tray hinge 280. Feed-tray hinge 280 is preferably fastened to feed tray 112 with counter-sink screws 285. Feed-tray hinge 280 is also preferably fastened to top 271 of panel 106 with at least one counter-sink screw 288. Upon reading the teachings of this specification, those skilled in the art will now appreciate that, under appropriate circumstances, considering such issues as cost, future technology, etc., other hinging attachments, such as, for example, piano hinges, pin hinges, flexible joints, etc., may suffice.

Figure 16:
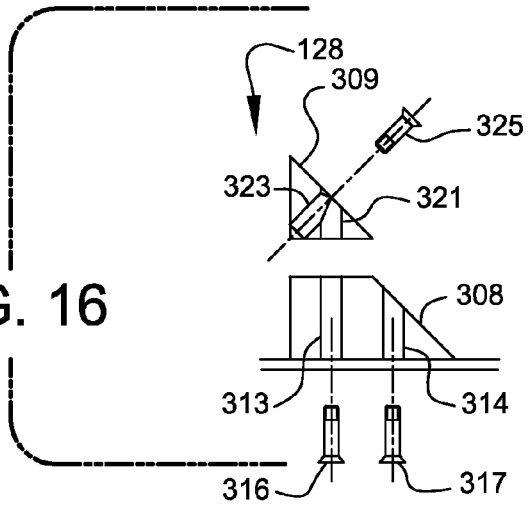
FIG. 16 shows a side exploded elevation view, illustrating at least one tray mount, according to the preferred embodiment of FIG. 15.

FIG. 16 shows a side exploded elevation view, illustrating tray mount 128, according to the preferred embodiment of FIG. 15. Tray mount 128 is preferably used to deploy feed tray 112 to angled position 114. Feed tray 112 preferably comprises tray mount 128, preferably two tray mounts 128. Tray mount 128 preferably comprises at least one tray mount base 308 and at least one tray mount top 309. Tray mount base 308 preferably comprises at least one threaded-hole 313 and at least one threaded-hole 314 to preferably receive at least one counter-sink screw 316 and counter-sink screw 317 respectively, preferably to mount tray mount 128 to panel 106, as shown in FIG. 17.

Tray mount top 309 preferably comprises at least one hole 321 and at least one threaded hole 323. Threaded hole 323 preferably receives at least one counter-sink screw 325 to preferably hold feed tray panel 291 to tray-mount top 309.

When user is ready to deploy feed tray 112 to angled position 114, feed tray 112 is preferably positioned to up position 327, as shown in FIG. 15. Up position 327 preferably allows mounting of tray mounts 128. Tray mounts 128 are preferably mounted as previously described. Feed-tray panel 291 is then preferably rotated back to angled position 114. Feed-tray panel 291 is then preferably secured to tray mounts 128 with counter-sink screw 325 as previously mentioned. Upon reading the teachings of this specification, those skilled in the art will now appreciate that, under appropriate circumstances, considering such issues as cost, future technologies, etc., other angled deployment methods, such as, for example, folding support arms, friction plates, locking hinges, etc., may suffice.

FIG. 17 shows a side view of magnetizer 101 illustrating feed tray 112 and tray mounts 128 deployed to operable configuration 109, according to the preferred embodiment of FIG. 16. User preferably deploys feed tray 112 by preferably attaching tray-mount base 308 to top 271 of panel 106. Counter-sink screw 316 and counter-sink screw 317 preferably enter tray-mount base 308 from underside 270 of panel 106.

Tray-mount top 309 is preferably attached to tray-mount base 308. Feed-tray panel 291 is preferably secured to tray-mount top 309 in angled position 114 by counter-sink screw 325. Feed-tray panel 291 is preferably held by feed-tray hinges 280 and tray mounts 128. Feed-tray panel 291 deployed to angled position 114 preferably puts feed tray 112 in operable configuration 109.

Feed tray 112, secured to tray mounts 128, preferably positions flexible magnetizable sheet 141 along feed path 143 towards magnetizer array 104. Flexible magnetizable sheet 141 is preferably positioned against the adjustable guide 294 as it is fed in.

Upon reading this specification, those with ordinary skill in the art will now appreciate that, under appropriate circumstances, considering such issues as design preference, user preferences, marketing preferences, cost, structural requirements, available materials, technological advances, etc., other flexible-magnetic sheet positioner arrangements such as, for example, magnetic sheet hoppers, motorized feed systems, or alternate guides to interface with magnetizer, etc., may suffice.

Figure 18:
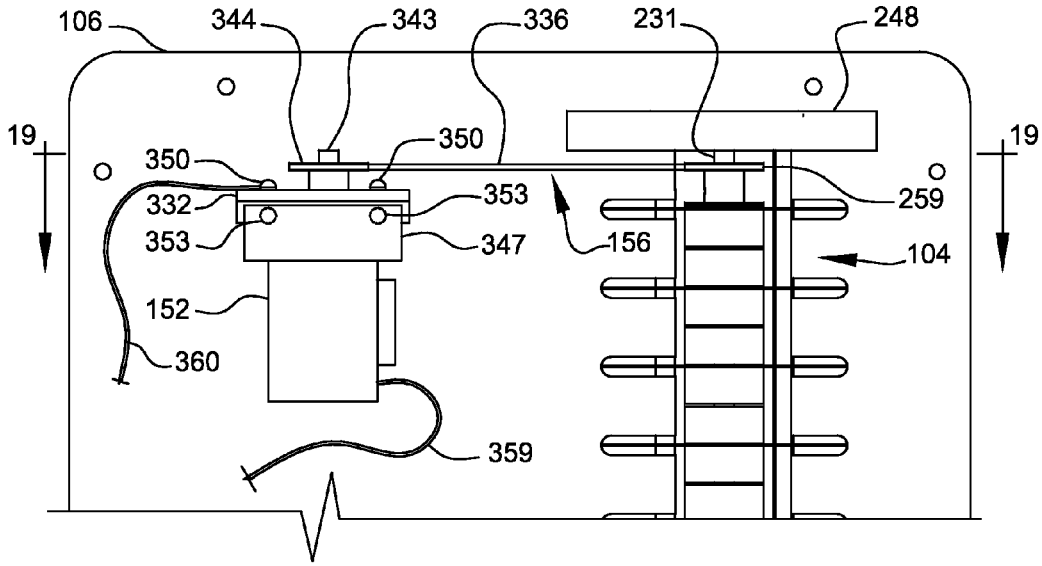
FIG. 18 shows partial underside view of such panel, illustrating at least one motor and chain drive, according to the preferred embodiment of FIG. 17.
Figure 19:
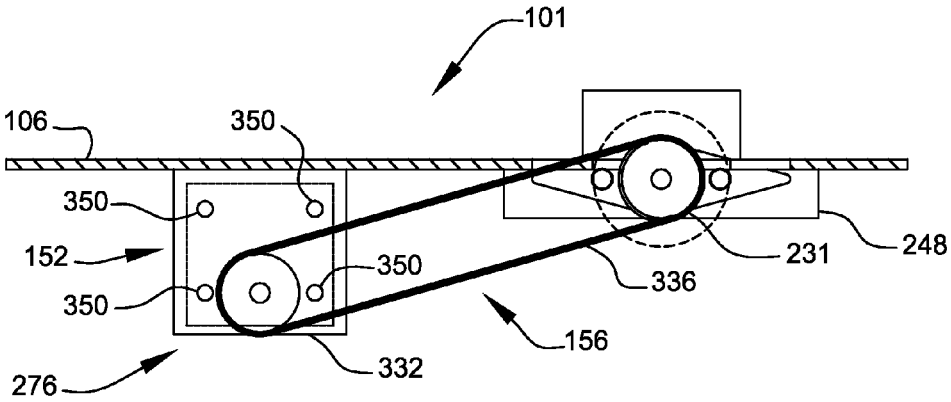
FIG. 19 shows the sectional view 19-19 of FIG. 18, illustrating such motor and chain drive.

FIG. 18 shows partial underside view of panel 106 illustrating at least one mechanical power subsystem 276, according to the preferred embodiment of FIG. 17. FIG. 19 shows the sectional view 19-19 of FIG. 18, illustrating mechanical power subsystem 276.

Panel 106 preferably encloses mechanical power subsystem 276, and motor electrical connections in lower portion 173 of briefcase enclosure 108, as shown in FIG. 4. Panel 106 also preferably allows for easy mounting of magnetizer array 104 and mechanical power subsystem 276. Panel 106 also preferably provides simplified access to maintain magnetizer 101. In the event magnetizer 101 requires maintenance or repairing, panel 106 is preferably removed for access to components of magnetizer 101.

Mechanical power subsystem 276 preferably comprises motor 152 and chain drive 156. Motor 152 preferably comprises at least one electric motor, preferably at least one McMaster Carr A/C Gear Motor Part #6142K57. McMaster Can A/C Gear Motor Part #6142K57 is available from McMaster Carr, located at 600 N. County Line Rd. Elmhurst, Ill. 60126-2081 (sales and customer service: 630-833-0300) or visit www.mcmaster.com on internet. Motor 152 also preferably comprises gearbox 347 and also preferably comprises at least one built in motor fan, preferably preventing overheating of motor 152. Upon reading the teachings of this specification, those skilled in the art will now appreciate that, under appropriate circumstances, considering such issues as cost, future technologies, etc., other motors, such as, for example, pneumatic motors, hydraulic motors, hand-actuated gearboxes, etc., may suffice.

Motor 152 is preferably attached to at least one angle bracket 332 by at least one motor-mount screw 350. Angle bracket 332 is preferably attached to panel 106 by motor-bracket screws 353.

Chain drive 156 preferably connects motor 152 to gear-drive endplate 259 on magnetizer array 104. Chain drive 156 preferably comprises at least one chain 336, gear-drive endplate 259, at least one motor-shaft 343, and at least one motor-gear 344. Motor 152 preferably connects to at least one gearbox 347. Gearbox 347 preferably connects to motor shaft 343. Motor-shaft 343 preferably connects to motor-gear 344. Chain 336 preferably connects motor-gear 344 to gear-drive endplate 259 on shaft 231.

Upon reading this specification, those with ordinary skill in the art will now appreciate that, under appropriate circumstances, considering such issues as design preference, user preferences, marketing preferences, cost, structural requirements, available materials, technological advances, etc., other rotary movement to shaft transfer arrangements such as, for example, gear transmission systems, belt drive, or direct drive systems, etc., may suffice.

Motor 152 preferably comprises at least one motor-power wire 359, at least one motor grounding wire 360, preferably connected to fuse 177, power cord receptacle 122 and power switch 131 (see FIG. 1). Fuse 177, power cord receptacle 122, and power switch 131, are preferably attached to briefcase enclosure 108 as best shown in FIG. 1. Portable magnetizer 105 is preferably fused for safety. Motor 152 is preferably wired to fuse 177, power cord receptacle 122, and power switch 131 in conventional electrical configuration.

Power switch 131 preferably activates motor 152. Motor 152 preferably sends mechanical power to gearbox 347. Gearbox 347 preferably transfers power to motor-shaft 343 and motor-gear 344. Motor-gear 344 preferably moves chain 336. Motor-gear 344 preferably drives gear-drive endplate 259 at about a one-to-one revolution ratio. Rotation of gear-driven endplate 259 preferably drives shaft 231 and magnetic roller 133.

Upon reading this specification, those with ordinary skill in the art will now appreciate that, under appropriate circumstances, considering such issues as design preference, user preferences, marketing preferences, cost, structural requirements, available materials, technological advances, etc., other rotary movement generator arrangements such as, for example, air motors, air powered motors, appliance motors, pneumatic motors, DC motors, hand crank, solar powered motors, or battery powered motors, etc., may suffice.

Figure 20:
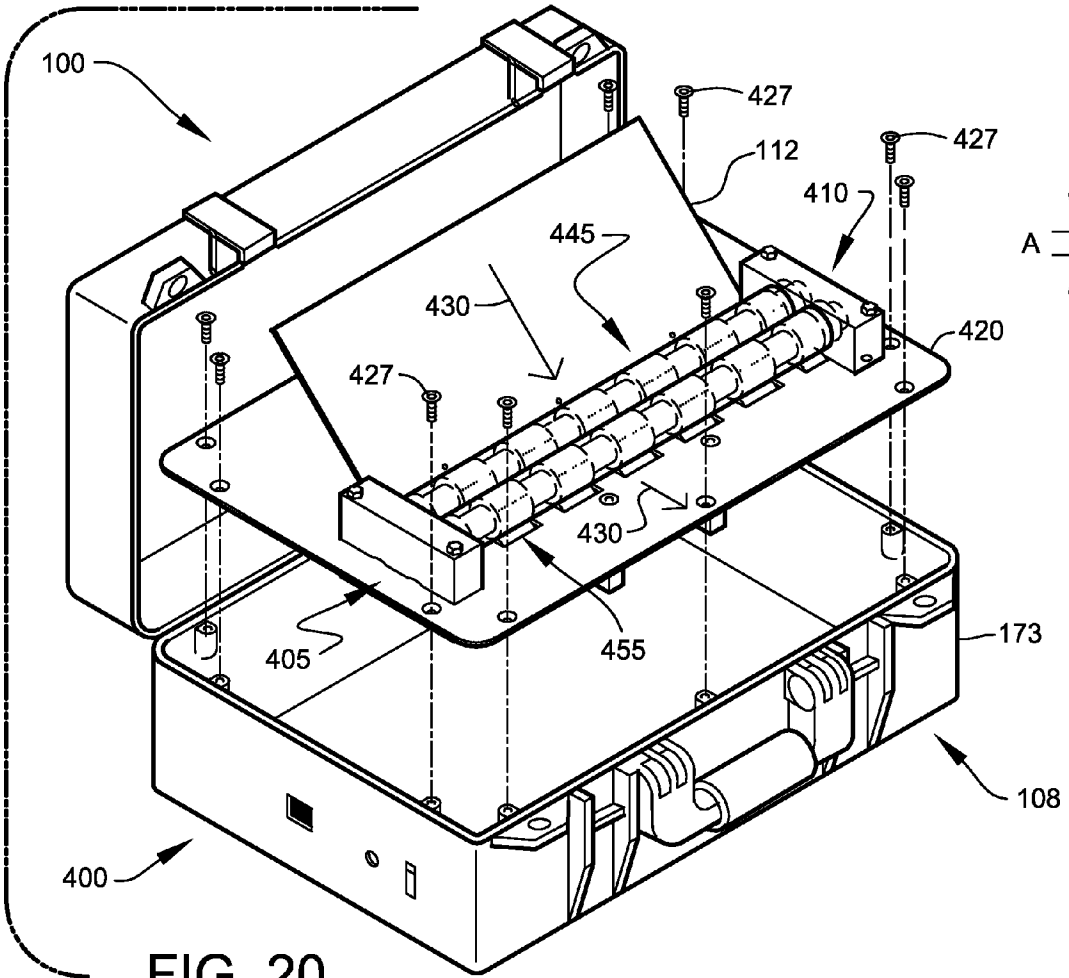
FIG. 20 shows a partial-exploded perspective view illustrating at least one high-energy portable magnetizer according to an alternately preferred embodiment of the present invention.

FIG. 20 shows a partial-exploded perspective view illustrating at least one high-energy portable magnetizer 400 according to an alternately preferred embodiment of the present invention. As many of the elements of high-energy portable magnetizer 400 are preferably retained from portable magnetizer 105, only structures and arrangements on the present embodiment, differing from the prior embodiment, will be elaborated upon.

Preferably, high-energy portable magnetizer 400 replaces magnetizer array assembly 205 of portable magnetizer 105 with at least one high-energy magnetizer array assembly 405. High-energy magnetizer array assembly 405 preferably comprises at least one upper magnetic field source 445 and at least one lower magnetic field source 455, as diagrammatically shown in FIG. 21.

Figure 21:
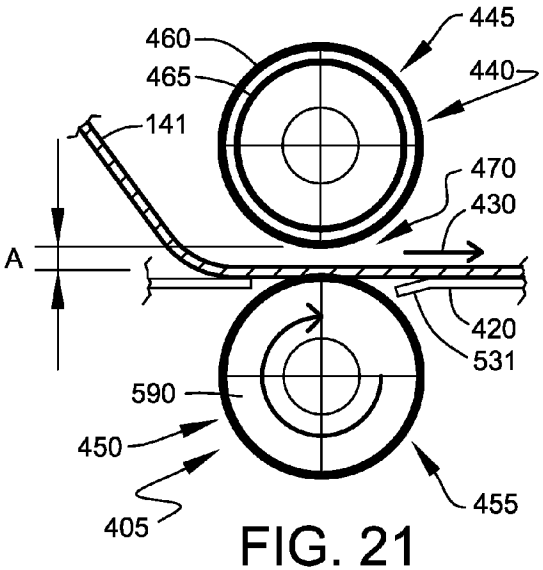
FIG. 21 shows a diagrammatic side view, illustrating at least one feed path through such at least one high-energy portable magnetizer, according to the preferred embodiment of FIG. 20.

FIG. 21 shows a diagrammatic side view, illustrating at least one feed path 430 extending through high-energy magnetizer array assembly 405, according to the preferred embodiment of FIG. 20. Referring to FIG. 21, lower magnetic field source 455 preferably comprises at least one magnetic roller assembly 450, as shown. Upper magnetic field source 445 preferably comprises at least one magnetic bar assembly 440. The upper magnetic bar assembly 440 and the lower magnetic roller assembly 450 are preferably situated to form at least one gap 470 therebetween. Gap 470 preferably comprises a preferred distance A of about ⅛ inch. Feed path 430 preferably extends through gap 470 in a preferred orientation about perpendicular to the longitudinal axes of magnetic bar assembly 440 and magnetic roller assembly 450, as shown. Due to the relative positions of magnetic bar assembly 440 and magnetic roller assembly 450, gap 470 preferably comprises at least one region of high magnetic flux.

Feed tray 112 (see FIG. 20) preferably functions to assist the positioning of flexible magnetic sheet 141 in an initial position within feed path 430. In addition, feed tray 112 assists in guiding flexible magnetic sheet 141 toward gap 470 and the lower magnetic roller assembly 450. The lower magnetic roller assembly 450 is preferably configured to drive flexible magnetic sheet 141 along feed path 430 through gap 470, similar to the previously-described magnetic roller 133.

Figures 22, 23:
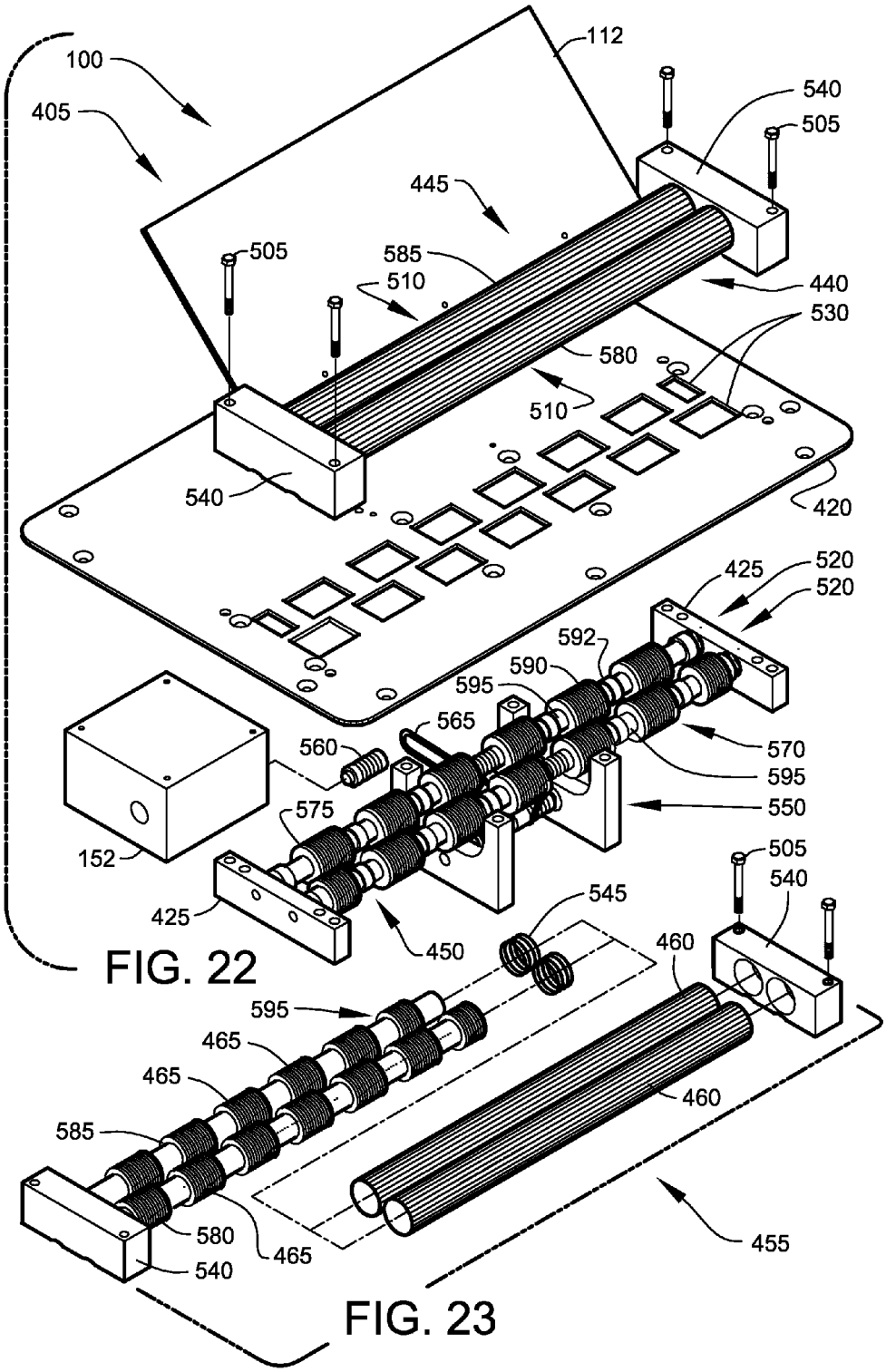
FIG. 22 shows an isometric exploded view, illustrating at least one high-energy magnetizer array assembly, according to the preferred embodiment of FIG. 21.
FIG. 23 shows an isometric exploded view, illustrating at least one upper magnetizer array subassembly, according to the preferred embodiment of FIG. 22.

FIG. 22 shows an isometric exploded view, further illustrating high-energy magnetizer array assembly 405, according to the preferred embodiment of FIG. 21. FIG. 23 shows an isometric exploded view, illustrating the preferred arrangements of upper magnetic bar assembly 440, according to the preferred embodiment of FIG. 22. Reference is now made to FIG. 21 and FIG. 22 with continued reference to FIG. 20 and FIG. 21.

The upper magnetic bar assembly 440 preferably comprises at least one upper magnetizer array subassembly 510, more preferably at least two magnetizer array subassemblies 510, as shown. Magnetic bar assembly 440 preferably comprises at least one smooth outer casing 460 and preferably comprises at least one magnetic stack 465, preferably contained within outer casing 460, as shown. Outer casing 460 preferably comprises at least one magnetically transparent material (material that does not significantly attenuate a magnetic field passing through the material), preferably brass. Upon reading the teachings of this specification, those skilled in the art will now appreciate that, under appropriate circumstances, considering such issues as future technologies, cost, etc., other magnetically transparent materials, such as, for example, magnetically-transparent plastics, magnetically-transparent ceramics, other magnetically transparent metals, etc., may suffice.

Correspondingly, the lower magnetic roller assembly 450 preferably comprises at least one magnetizer array subassembly 520, preferably at least two magnetizer array subassemblies 520, as shown. The functional relationship between the two lower magnetizer array subassemblies 520 is representative of the functional relationship between the two upper magnetizer array subassemblies 510. For conciseness and clarity of description, the functional relationship between the two magnetizer array subassemblies 520 will be discussed with the understanding that the teachings are equally applicable to the functional relationship between the two upper magnetizer array subassemblies 510.

Each magnetizer array subassembly 520 preferably comprises at least one leading magnetic roller 575 and preferably at least one trailing magnetic roller 570. Each upper magnetizer array subassembly 510 preferably comprises at least one leading magnetic bar 585 and preferably at least one trailing magnetic bar 580. Both magnetic roller assemblies 450 and magnetic bar assemblies 440 preferably extend across substantially the full width of feed path 430 and flexible magnetic sheet 141.

Leading magnetic roller 575 preferably comprises at least one rotational shaft 595 preferably oriented substantially perpendicular to the line of direction of feed path 430 (as generally defined by the direction of sheet motion), as shown. Leading magnetic roller 575 preferably comprises a first set of magnetic stacks 590, preferably spaced substantially along the length of rotational shaft 595, as shown. Each magnetic stack 590 preferably comprises an alternating sequence of magnetic plates and flux-conducting plates in a configuration preferably matching those of the previously-described magnetic stacks 239 shown and described in FIG. 8A and FIG. 8B. Each magnetic plate preferably comprises a high-strength permanent magnet and each flux-conducting plate preferably comprises a material exhibiting high permeability when saturated. Both magnetic plates and flux-conducting plates preferably comprise substantially circular peripheral shapes. Each substantially circular magnetic plate and each substantially circular flux-conducting plate are preferably substantially coaxial with rotational shaft 595, as shown. Thus, the sequential laminations of each magnetic stack 590 form a substantially cylindrical peripheral surface.

Magnetic stacks 590 are preferably mounted coaxially on rotational shaft 595, as shown. Magnetic stacks 590 are preferably separated by a set of spacers 592 that are also preferably mounted coaxially on rotational shaft 595, as shown. Spacers 592 preferably comprise widths generally slightly shorter than those of magnetic stacks 590, as shown. As in the prior magnetic stacks 239, magnetic stacks 590 preferably each comprise a 16-PPI stack 237, as shown in FIG. 8A.

Magnetic stacks 590 for high-energy magnetizer array assembly 405 preferably comprise a length of about 1⅛ inch. Spacers 592 preferably comprise a width of about 1 inch.

The preferred structures and arrangements of the upper leading magnetic bar 585 are substantially identical to those of the lower leading magnetic roller 575, as described above. Preferably, the placements of magnetic stacks 465 along rotational shaft 595 of leading magnetic bar 585 are substantially identical to those of leading magnetic roller 575. This preferably places magnetic stacks 465 of leading magnetic bar 585 in vertical alignments with magnetic stacks 590 of leading magnetic roller 575. Thus, a plurality of first high-magnetic-flux field regions (six in the depicted embodiment) are preferably generated within the leading gap 645 (see FIG. 26) by the preferred vertical stacking of leading magnetic roller 575 below leading magnetic bar 585 and the resulting formation of magnetic flux circuits between leading magnetic roller 575 and leading magnetic bar 585.

The preferred structures and arrangements of trailing magnetic roller 570 are substantially similar to those of leading magnetic roller 575, with the exception of the preferred positioning of magnetic stacks 590 along rotational shaft 595, as shown. Note that magnetic stacks 590 of trailing magnetic roller 570 are preferably axially offset from magnetic stacks 590 of leading magnetic roller 575. More preferably, magnetic stacks 590 of trailing magnetic roller 570 are axially offset a preferred distance substantially equal to the width of one magnetic stack 590, as shown (similarly, magnetic stack 465 of the upper trailing magnetic bar 580 are axially offset from magnetic stack 465 of the upper leading magnetic bar 585), preferably centering magnetic stacks 590 of leading magnetic roller 575 on spacers 592 of trailing magnetic roller 570. This preferred arrangement produces a plurality of second high-magnetic-flux field regions (seven in the depicted embodiment) within trailing gap 640 (see FIG. 26), each of such second high-magnetic-flux field regions preferably generated by the preferred vertical stacking of trailing magnetic roller 570 below trailing magnetic bar 580. Note that the plurality of such second high-magnetic-flux field regions of trailing gap 640 are preferably axially offset from the plurality of such first high-magnetic-flux field regions of leading gap 645.

The preferred axial offsetting of the above-described magnetic stacks assures that the full width of flexible magnetic sheet 141 is exposed to at least one of the above-described high-magnetic-flux field regions as it is advanced along feed path 430, as shown. Thus, magnetization of flexible magnetic sheet 141 preferably occurs in parallel strips defined by alternating exposure to the magnetic fields of the leading and trailing magnetic rollers. The preferred axial offsetting of the depicted embodiment has been determined to reduce feed-related problems related to the adhering and wrapping of flexible magnetic sheet 141 around the magnetic rollers during operation. Upon reading the teachings of this specification, those of ordinary skill in the art will now understand that, under appropriate circumstances, considering such issues as intended use, physical characteristics of the flexible magnetic sheet, etc., other magnet arrangements, such as utilizing a continuous array of magnets extending substantially across the sheet width, etc., may suffice.

High-energy magnetizer array assembly 405 preferably comprises at least one magnetizer array plate 420. Magnetizer array plate 420 preferably mounts to lower portion 173 of briefcase enclosure 108, as shown, preferably with mounting fasteners 427 (see FIG. 20), preferably mounting screws. Upon reading the teachings of this specification, those skilled in the art will now appreciate that, under appropriate circumstances, considering such issues as future technologies, cost, etc., other mounting fasteners, such as, for example, bolts, snap-fit fasteners, twist-lock fasteners, etc., may suffice. Magnetizer array plate 420 preferably includes a set of rectangular-shaped apertures 530, preferably arranged in an offset configuration, as shown, corresponding to layout of magnetic stacks 590 of leading magnetic roller 575 and trailing magnetic roller 570. Rectangular-shaped apertures 530 preferably allow the magnetic stacks 590 of magnetic roller assembly 450 to project upwardly through magnetizer array plate 420 to contact flexible magnetic sheet 141, as shown in FIG. 21. In one preferred embodiment of the system, the trailing edge of each aperture 530 and opening preferably comprises an angled ramp 531, as diagrammatically shown in FIG. 21. Preferably, such angled ramps assists in maintaining smooth and consistent feed performance by reducing the tendency of flexible magnetic sheet to contact the trailing edge of the apertures due to magnetic adherence to the magnetizer banks. Preferably, each angled ramp comprises a tapered cut within the plate. More preferably, the angled ramps are formed by modifying a section of the plate to allow bending of the trailing edge of the aperture downward, as diagrammatically shown in FIG. 21.

The upper magnetic bar assembly 440 preferably mounts above magnetizer array plate 420, preferably outside lower portion 173 of briefcase enclosure 108. The lower magnetic roller assembly 450 preferably mounts below magnetizer array plate 420, preferably inside lower portion 173 of briefcase enclosure 108. At least one magnetizer array mounting fastener 505 preferably secures both the upper magnetic bar assembly 440 and the lower magnetic roller assembly 450, preferably by passing through magnetizer array plate 420, as shown. Magnetizer array mounting fastener 505 preferably comprises at least one bolt.

Magnetizer array mounting fastener 505 preferably secures at least one lower mounting bracket 425 to upper mounting bracket 540, preferably sandwiching magnetizer array plate 420 therebetween. At least two lower mounting brackets 425 preferably hold the lower magnetizer array subassemblies 520, and at least two upper mounting brackets 540 preferably hold the upper magnetizer array subassemblies 510 in operable positions, as shown.

Each of the upper magnetizer array subassemblies 510 preferably further comprise at least one roller float spring 545, preferably at least two roller float springs 545. Roller float springs 545 preferably are positioned at each end of a respective magnetic bar, preferably inside outer casing 460. Roller float springs 545 preferably allow the series of magnetic stacks 465 to shift in a longitudinal direction, preferably to magnetically align with the lower magnetic stacks 590. In one preferred arrangement, outer casing 460 is preferably free to rotate in upper mounting bracket 540 and the internal magnetic bar is preferably free to longitudinally slide inside outer casing 460. Preferably, leading magnetic bar 585 and trailing magnetic bar 580 are thereby free to translate in order to achieve optimal alignment with the upper and lower magnetic stacks, thus optimizing the high-magnetic-flux regions, as described herein. Upon reading the teachings of this specification, those skilled in the art will now appreciate that, under appropriate circumstances, considering such issues as cost, future technologies, etc., other mounting arrangements, such as, for example, vertically shifting outer casings, fine gap adjustments, etc., may suffice.

Figures 27B, 28:
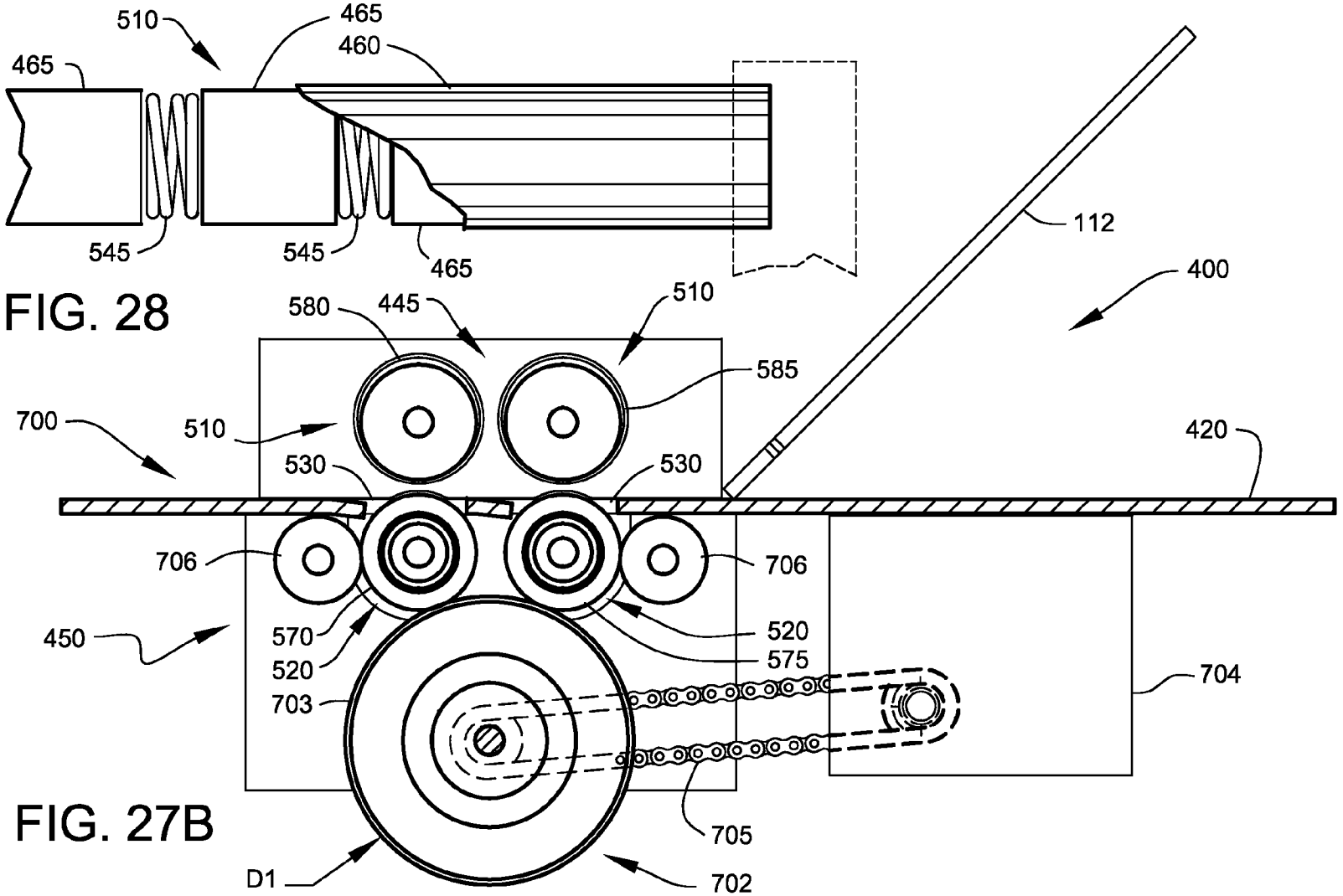
FIG. 27B shows the sectional view 27B-27B of FIG. 27A, illustrating the alternate rotational drive subassembly of FIG. 27A
FIG. 28 shows a partial cut-away front view, illustrating an alternate high-energy magnetizer array assembly, according to another preferred embodiment of the present invention.

Alternately preferably, each magnetic stack 465 of the upper magnetizer array subassemblies 510 are preferably separated by a roller float spring 545, as illustrated in FIG. 28.

This alternate preferred arrangement permits each magnetic stack 465, of the upper magnetic bars, to align with a corresponding magnetic stack 590 of the adjacent of lower magnetizer array subassembly 520.

The lower magnetic roller assembly 450 preferably connects to motor 152 with at least one rotational drive subassembly 550. Motor 152 preferably attaches to at least one motor drive shaft 560, and preferably rotates motor drive shaft 560 during operation. Motor drive shaft 560 preferably attaches to rotational drive subassembly 550 with at least one motor drive belt 565, as shown. Upon reading the teachings of this specification, those skilled in the art will now appreciate that, under appropriate circumstances, considering such issues as cost, future technologies, etc., other drive train connections, such as, for example, chains, gears, rollers, etc., may suffice.

Figure 24:
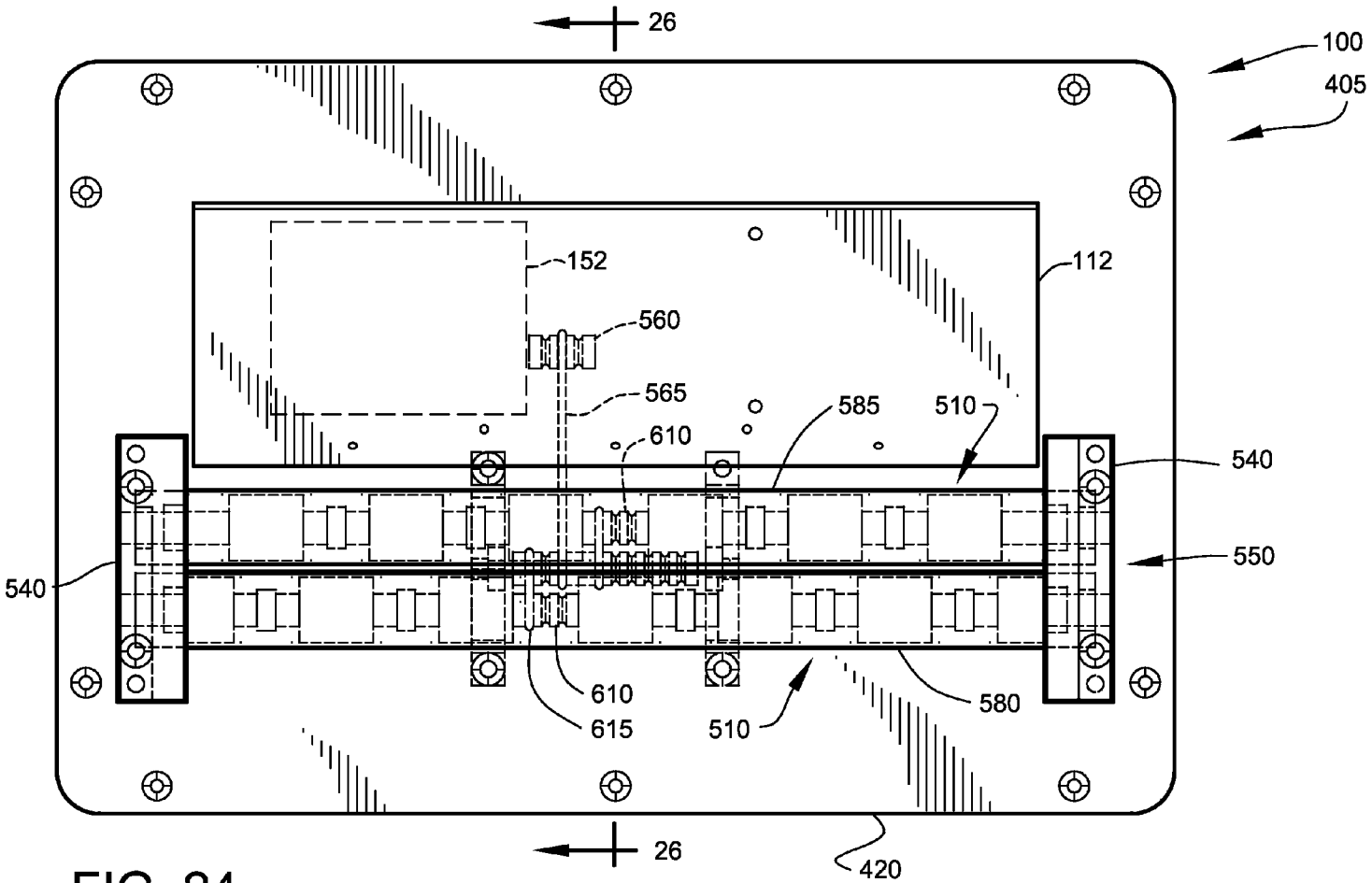
FIG. 24 shows a top view of such at least one high-energy magnetizer array assembly, illustrating at least one rotational drive subassembly, according to the preferred embodiment of FIG. 23.
Figure 25:
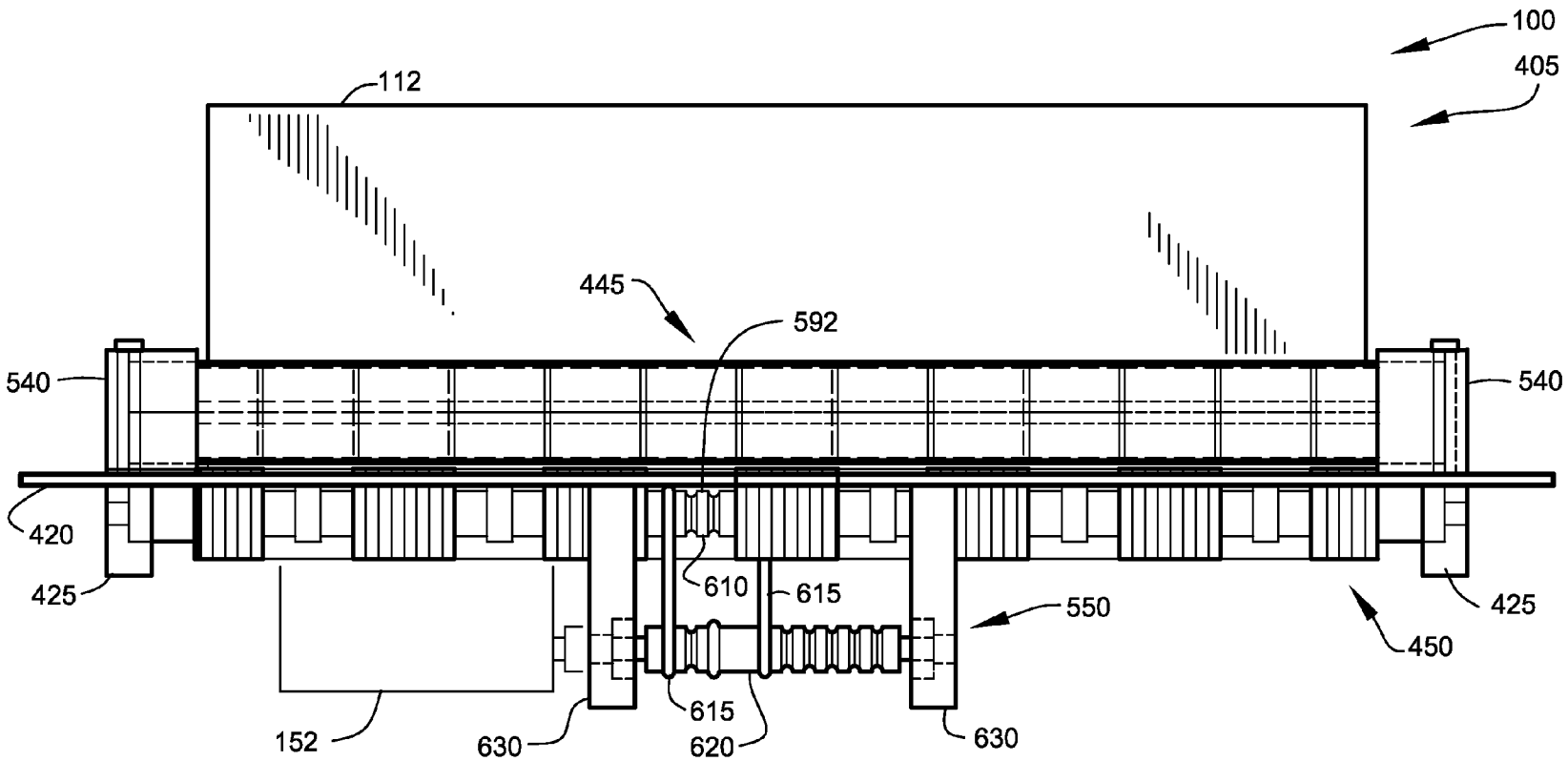
FIG. 25 shows a front view of such at least one high-energy magnetizer array assembly, illustrating such at least one rotational drive subassembly, according to the preferred embodiment of FIG. 23.
Figure 26:
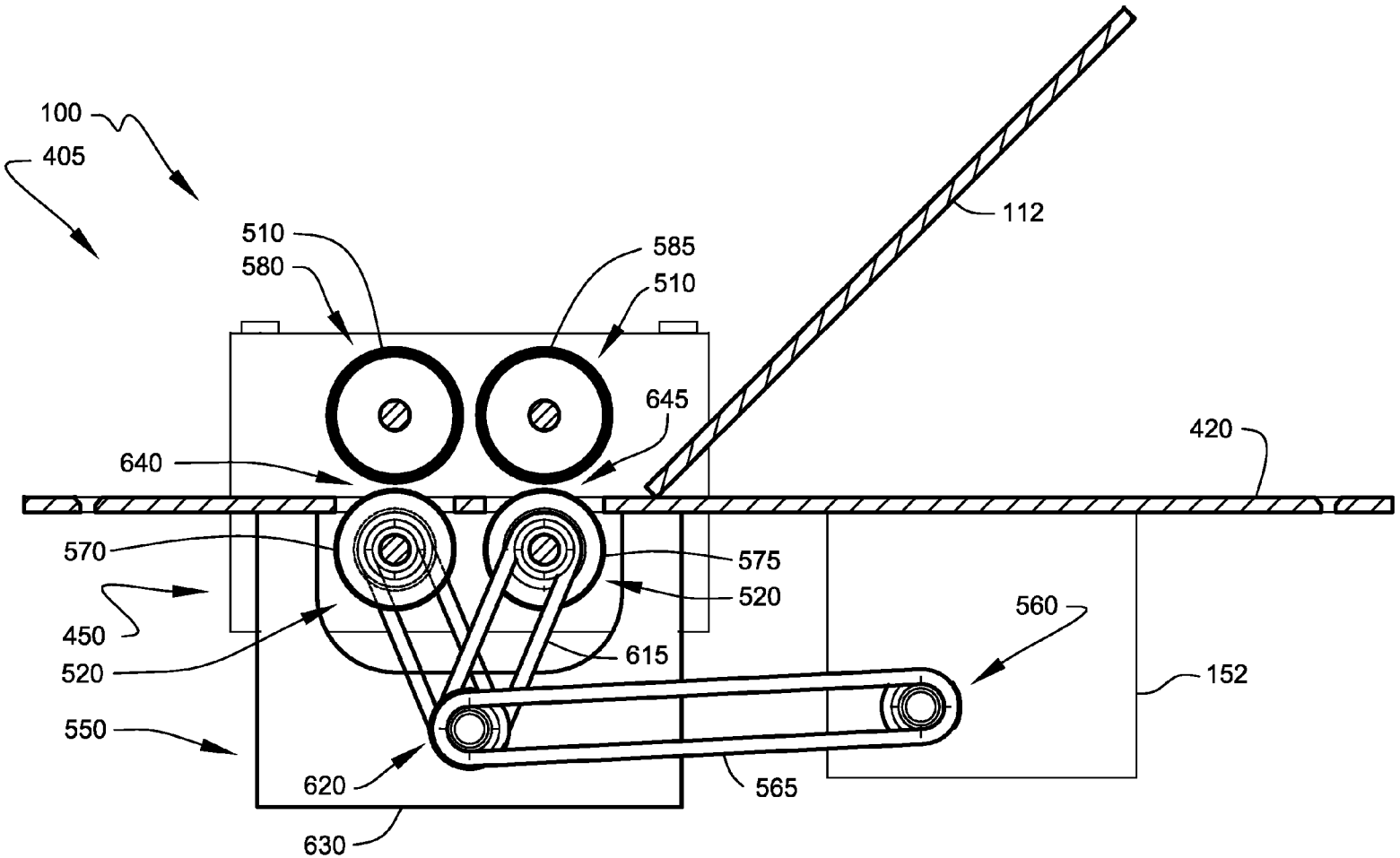
FIG. 26 shows the sectional view 26-26 of FIG. 24, illustrating the high-energy magnetizer array assembly.

FIG. 24 shows a top view of high-energy magnetizer array assembly 405, illustrating rotational drive subassembly 550, according to the preferred embodiment of FIG. 22. FIG. 25 shows a front view of high-energy magnetizer array assembly 405, illustrating rotational drive subassembly 550, according to the preferred embodiment of FIG. 22. FIG. 26 shows the sectional view 26-26 of FIG. 24, illustrating rotational drive subassembly 550.

Rotational drive subassembly 550 preferably comprises at least one drive assembly mount 630, at least one roller drive shaft 620, and at least one roller drive belt 615. Rotational drive assembly 550 preferably transfers rotations motion from motor 152 to magnetic roller assembly 450, preferably in a 1:1 ratio. Upon reading the teachings of this specification, those skilled in the art will now appreciate that, under appropriate circumstances, considering such issues as cost, future technologies, etc., other rotational drive assemblies, such as, for example, gear boxes, direct drives, chain drives, friction roller drives, etc., may suffice.

Drive assembly mount 630 preferably mounts roller drive shaft 620 under magnetic roller assembly 450, as shown in FIG. 25. Roller drive belt 615 preferably connects roller drive shaft 620 to magnetic roller assembly 450, preferably transferring rotational motion during operation. Each magnetic roller preferably comprises at least one drive spacer 610, preferably where roller drive belt 615 attaches, preferably comprising at least one of spacers 592. Motor drive belt 565 preferably transfers rotational motion from motor drive shaft 560 to roller drive shaft 620, during operation.

Figure 27A:
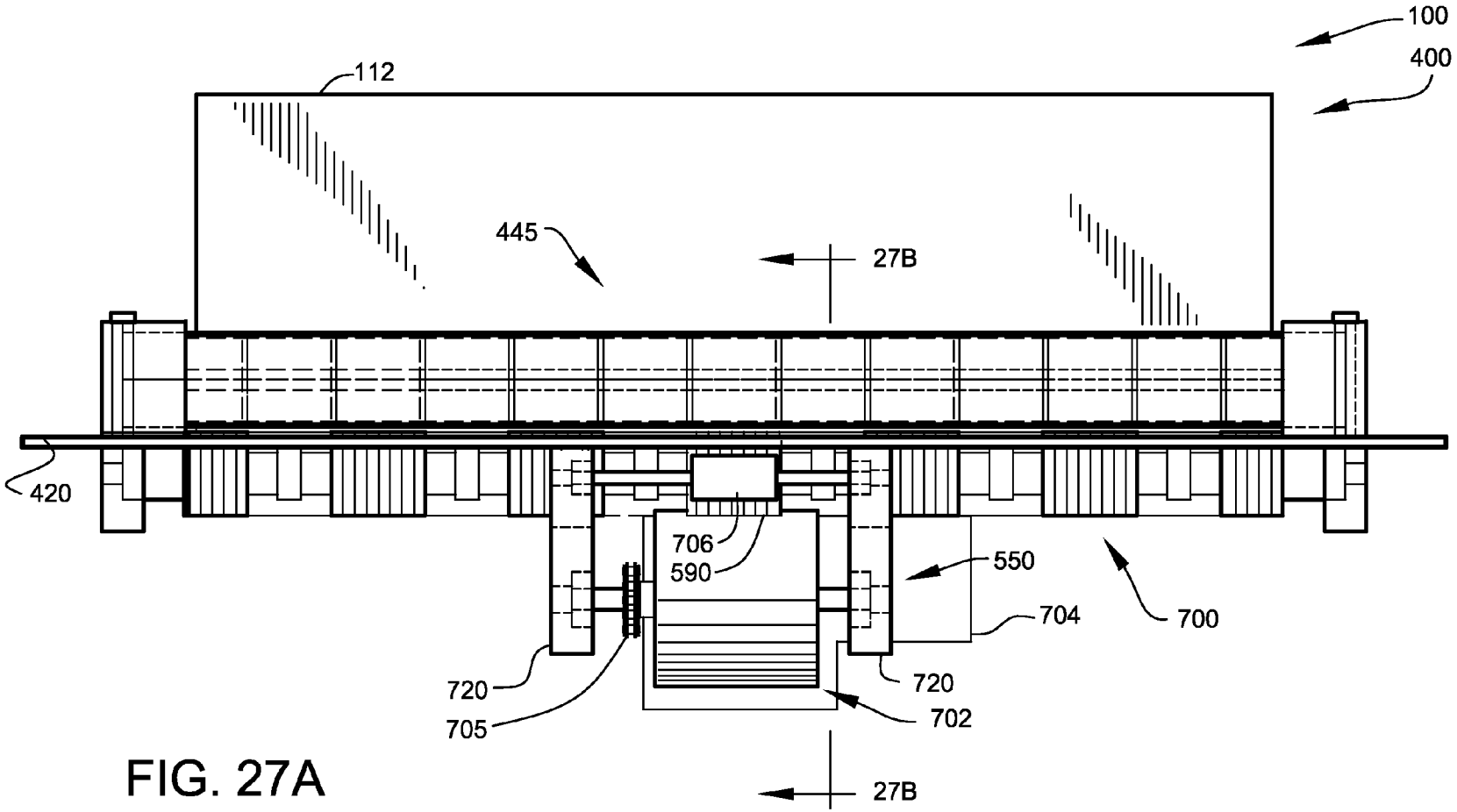
FIG. 27A shows a front view of alternate high-energy magnetizer array assembly, illustrating an alternate rotational drive subassembly, according to another preferred embodiment of the present invention.

FIG. 27A shows a front view of an alternate high-energy portable magnetizer 400, modified to comprise alternate rotational drive subassembly 700, according to another preferred embodiment of the present invention. FIG. 27B shows the sectional view 27B-27B of FIG. 27A, illustrating the alternate rotational drive subassembly 700 of FIG. 27A.

Alternate rotational drive subassembly 700 differs from the prior embodiment in that magnetic roller assembly 450 is driven by a large-diameter shaft-mounted drive roller 702, as shown. Drive roller 702 preferably comprises a resilient outer surface 703, as shown. Resilient outer surface 703 of drive roller 702 preferably comprises at least one synthetic rubber, preferably a urethane material having a 35 A durometer hardness. Drive roller 702 preferably comprises an outer diameter D1 of about 2½ inches. One preferred urethane roller suitable for use as drive roller 702 comprises a unit having a width of about 1.9 inches and an internal bore of about 1 inch, preferably a McMaster Can urethane roller Part number 2475K104 available from McMaster Carr, located at 600 N. County Line Rd. Elmhurst, Ill. 60126-2081. Drive roller 702 is preferably figured to be coupled to motor 704 by chain drive 705, as shown. In this preferred alternate arrangement, motor 704 preferably comprises a McMaster Carr AC Gear motor, part number 6142K58, providing about 75 revolutions per minute, about 10-inch pounds of torque, and preferably operating on a 115 volts alternating circuit.

Drive roller 702 is preferably mounted to the underside of magnetizer array plate 420 by a set of side-positioned mounting plates 720, as shown. Mounting plates 720 are preferably configured to support drive roller 702 while preferably providing clearance to accommodate free rotation of magnetic roller assembly 450. This preferred mounting arrangement preferably places the resilient outer surface 703 of drive roller 702 in direct contact with one or more magnetic stacks 590 of the lower magnetic roller assembly 450, as shown. Preferably, rotation of leading magnetic roller 575 and trailing magnetic roller 570 is induced by the operation of motor 704 acting through chain drive 703 and drive roller 702.

In addition, alternate rotational drive subassembly 700 preferably comprises a set of rotatable magnet stay rollers 706, preferably configured to limit load deflections and maintain positioning of leading magnetic roller 575 and trailing magnetic roller 570 within magnetic roller assembly 450 during operation. Preferably, deflection within each magnetic roller is limited by the application of a force to the lower magnetic roller assembly 450 opposing the upward force applied to magnetic roller assembly 450. Magnet stay rollers 706 are preferably located adjacent each magnetic roller, preferably in front of leading magnetic roller 575 and behind trailing magnetic roller 570, as shown. Magnet stay rollers 706 preferably each comprise McMaster Carr Part number 2473K22 comprising a press-fit drive roller having about a ¾-inch outer diameter and about a ¾-inch width with a ¼-inch inside bore diameter. Magnet stay rollers 706 are preferably rotatably supported within the support of side mounting plates 720, as shown.

The above-described preferred arrangements of alternate rotational drive subassembly 700 have been found by applicant to provide improved performance in conjunction with the high-energy embodiments. In particular, the above-described preferred arrangement of alternate rotational drive subassembly 700 preferably provide reduced noise during operation, sufficient torque transfer within the high magnetic field pathway, and provides reduced wear in service.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to enabling magnetization of at least one planar sheet of flexible magnetizable material, said system comprising:

a) at least one magnetizer structured and arranged to multipole magnetize the at least one planar sheet, in an alternating pattern of pole pairs, using at least one magnetic field source; and b) at least one briefcase-type enclosure structured and arranged to enclose said at least one magnetizer;

c) wherein said at least one briefcase-type enclosure comprises at least one handle configured to assist single-hand carrying of said at least one briefcase-type enclosure enclosing said at least one magnetizer; and d) wherein the at least one planar sheet, when magnetized by said at least one magnetizer, is capable of magnetically adhering to at least one magnetically receptive material.

2. The system, according to claim 1, wherein said at least one magnetizer comprises at least one permanent magnet.

3. The system, according to claim 2, wherein:

a) said at least one magnetizer comprises at least one magnetizer bar comprising at least one longitudinal axis;

b) said at least one magnetizer bar comprises a plurality of discrete field-producing lamination-sets spaced along said at least one longitudinal axis;

c) each discrete field-producing lamination-set of said plurality comprises at least one circular magnetic disk and at least one circular flux-conducting spacer magnetically coupled with said at least one circular magnetic disk; and d) each said at least one circular magnetic disk and each said at least one circular flux-conducting spacer are coaxial with said at least one longitudinal axis.

4. The system, according to claim 3, further comprising: at least one rotary movement generator structured and arranged to generate rotary movement of said at least one magnetizer bar about said at least one longitudinal axis.

5. The system, according to claim 4, wherein said at least one magnetizer bar is structured and arranged to magnetically couple to the at least one planar sheet, when the at least one planar sheet is in position to pass through at least one magnetic field produced by said at least one magnetic field source, to transfer movement to the at least one planar sheet.

6. The system, according to claim 5, wherein said at least one magnetizer bar is structured and arranged to assist movement of the at least one planar sheet through at least one magnetic field by such rotary movement of said at least one magnetizer bar about said at least one longitudinal axis.

7. The system, according to claim 3, wherein said at least one magnetizer bar comprises at least one magnetizer bar set situate partially above and partially below a movement track of the at least one planar sheet.

8. The system, according to claim 7, wherein said at least one magnetizer bar set comprises at least two magnetizer bar sub-sets, each said magnetizer bar sub-set comprising:

a) at least one magnetic field source above the movement track;

b) at least one magnetic field source below the movement track; and c) at least one flux field situate between said at least one magnetic field source above the movement track and said at least one magnetic field source below the movement track;

d) wherein said at least one flux field crosses the movement track.

9. The system, according to claim 8, wherein each at least one magnetic field source above the movement track is encased to provide at least one smooth surface.

10. The system, according to claim 3, wherein said at least one magnetizer bar comprises at least one magnetizer bar set situate below a movement track of the at least one planar sheet.

11. The system, according to claim 6, wherein said at least one rotary movement generator comprises:

a) at least one electrical motor; and b) at least one power cord structured and arranged to assist power transfer from at least one external power source to said at least one electrical motor;

c) wherein said at least one power cord may be contained within said at least one briefcase-type enclosure when stored.

12. The system, according to claim 1, further comprising:

a) at least one positioner structured and arranged to permit positioning the at least one planar sheet into at least one magnetizing interaction relationship with said at least one magnetizer;

b) wherein said at least one positioner comprises at least one user-adjustable planar sheet feeder structured and arranged to user-adjustably feed the at least one planar sheet into said at least one magnetizer.

13. The system, according to claim 12, wherein said at least one adjustable planar sheet feeder accepts a sheet width of less than about 13 inches.

14. The system, according to claim 13, wherein said at least one adjustable planar sheet feeder collapses to allow containment in said at least one enclosure when stored.

15. The system, according to claim 6, wherein said at least one rotary movement generator further comprises:

a) In contact with said at least one magnetizer bar, at least one drive roller structured and arranged to generate such rotary movement of said at least one magnetizer bar;

b) wherein said at least one drive roller is operably coupled with said at least one motor.

16. The system, according to claim 15 wherein said at least one drive roller comprises at least one resilient contact surface structured and arranged to resiliently contact said at least one magnetizer bar during generation of such rotary movement.

17. The system, according to claim 16 wherein:

a) said at least one magnetizer bar comprises at least one magnetizer bar set situate partially above and partially below a movement track of the at least one planar sheet;

b) said at least one magnetizer bar set comprises at least two magnetizer bar sub-sets, each said magnetizer bar sub-set comprising i) at least one magnetic field source above the movement track, ii) at least one magnetic field source below the movement track, and iii) at least one flux field situate between said at least one magnetic field source above the movement track and said at least one magnetic field source below the movement track;

c) wherein said at least one flux field crosses the movement track.

18. A system, related to magnetization of at least one substantially planar sheet of substantially flexible magnetizable material, said system comprising:

a) at least one first magnetic field source structured and arranged to produce at least one first magnetic field;

b) at least one second magnetic field source structured and arranged to produce at least one second magnetic field; and c) at least one geometric positioner structured and arranged to geometrically position said at least one first magnetic field source and said at least one second magnetic field source to generate at least one first magnetic-flux field region resulting from at least one magnetic-field interaction between said at least one first magnetic field and said at least one second magnetic field;

d) within said at least one geometric positioner, at least one passage structured and arranged to allow moving passage of the substantially flexible magnetizable material through said at least one first magnetic-flux field region;

e) at least one user-adjustable planar sheet feeder structured and arranged to user-adjustably feed the at least one planar sheet through said at least one first magnetic-flux field region;

f) at least one sheet mover to assist movement of the at least one planar sheet through such at least one first magnetic-flux field region; and g) at least one enclosure structured and arranged to enclose said at least one first magnetic field source, said at least one second magnetic field source, and said at least one geometric positioner; and h) wherein said at least one enclosure comprises at least one hand-carrier structured and arranged to assist single-hand carrying of said at least one enclosure;

i) wherein the at least one planar sheet is at least partially magnetized by passage through such at least one first magnetic-flux field region.

19. The system, according to claim 18, wherein said at least one user-adjustable planar sheet feeder is collapsible to permit closure of said at least one enclosure.

20. The system, according to claim 19, wherein:

a) each of said at least one first magnetic field source and said at least one second magnetic field source comprises at least one magnetizer bar comprising at least one longitudinal axis;

b) said at least one magnetizer bar comprises a plurality of discrete field-producing lamination-sets spaced along said at least one longitudinal axis;

c) each discrete field-producing lamination-set of said plurality comprises at least one circular magnetic disk and at least one circular flux-conducting spacer magnetically coupled with said at least one circular magnetic disk; and d) each said at least one circular magnetic disk and each said at least one circular flux-conducting spacer are coaxial with said at least one longitudinal axis.

21. The system, according to claim 20, wherein said at least one sheet mover comprises:

a) at least one rotary movement generator structured and arranged to generate rotary movement of said at least one magnetizer bar;

b) wherein said at least one magnetizer bar is structured and arranged to magnetically couple to the at least one planar sheet, when the at least one planar sheet is in position to pass through such at least one first magnetic-flux field region, to transfer movement to the at least one planar sheet.

22. A system, relating to enabling magnetization of at least one planar sheet of flexible magnetizable material, said system comprising:

a) magnetizer means for multipole magnetizing the at least one planar sheet, in an alternating pattern of pole pairs, using at least one magnetic field source; and b) enclosure means for enclosing said at least one magnetizer;

c) wherein said enclosure means comprises hand-carrier means for assisting hand-carrying, with one hand, of said enclosure means;

c) wherein the at least one planar sheet, when magnetized by said magnetizer means, is capable of magnetically adhering to at least one magnetically receptive material.

* * * * *